US009291955B2

(12) United States Patent
Nakamura et al.

(10) Patent No.: US 9,291,955 B2
(45) Date of Patent: Mar. 22, 2016

(54) IMAGE FORMING APPARATUS AND TRANSFER BIAS APPLICATION DEVICE THEREIN

(71) Applicants: Keigo Nakamura, Kanagawa (JP); Yasunobu Shimizu, Kanagawa (JP); Hiromi Ogiyama, Tokyo (JP); Hirokazu Ishii, Tokyo (JP); Shinya Tanaka, Kanagawa (JP)

(72) Inventors: Keigo Nakamura, Kanagawa (JP); Yasunobu Shimizu, Kanagawa (JP); Hiromi Ogiyama, Tokyo (JP); Hirokazu Ishii, Tokyo (JP); Shinya Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/728,641

(22) Filed: Jun. 2, 2015

(65) Prior Publication Data

US 2015/0261143 A1 Sep. 17, 2015

Related U.S. Application Data

(63) Continuation of application No. 13/718,395, filed on Dec. 18, 2012, now Pat. No. 9,122,207.

(30) Foreign Application Priority Data

Dec. 26, 2011 (JP) ..... 2011-283112

(51) Int. Cl.
*G03G 15/16* (2006.01)

(52) U.S. Cl.
CPC ..... *G03G 15/1665* (2013.01); *G03G 15/1605* (2013.01); *G03G 15/1675* (2013.01)

(58) Field of Classification Search
CPC ..... G03G 15/1605; G03G 15/1675; G03G 15/1665
USPC ..... 399/66, 49, 302, 308, 314
See application file for complete search history.

(56) References Cited

U.S. PATENT DOCUMENTS 6,965,742 B2 11/2005 Miyamoto et al.
8,787,806 B2 7/2014 Nakamura et al.

(Continued)

FOREIGN PATENT DOCUMENTS

JP H02-129678 A 5/1990
JP 04-086878 3/1992

(Continued)

OTHER PUBLICATIONS

Machine translation of JP 2000-112298 (publicatino date of Apr. 21, 2000) printed on Jun. 15, 2015.*

(Continued)

*Primary Examiner* — Sophia S Chen
(74) *Attorney, Agent, or Firm* — Oblon, McClelland, Maier & Neustadt, L.L.P.

(57) ABSTRACT

An image forming apparatus includes an image bearing member, a transfer member disposed facing the image bearing member to form a transfer region therebetween, a transfer bias application device to apply to the transfer region a transfer bias including a direct current (DC) component and an alternating current (AC) component to transfer the toner image onto the recording medium as the recording medium passes through the transfer region, and a controller operatively connected to the transfer bias application device to allow, during a bias change period in a sheet absent period in which the image bearing member rotates and no recording medium passes through the transfer region, the transfer bias application device to selectively apply to the transfer region one of the transfer bias without the AC component and the transfer bias with a peak-to-peak voltage of the AC component less than that applied in image formation.

26 Claims, 12 Drawing Sheets

(56) References Cited

U.S. PATENT DOCUMENTS

| | | | | |
|---|---|---|---|---|
| 8,965,227 | B2 | 2/2015 | Mizutani et al. | |
| 9,020,382 | B2 | 4/2015 | Aoki et al. | |
| 2002/0044798 | A1* | 4/2002 | Katsumi et al. | 399/297 |
| 2003/0035658 | A1 | 2/2003 | Ishii | |
| 2005/0147424 | A1 | 7/2005 | Kato et al. | |
| 2005/0180767 | A1 | 8/2005 | Ishii et al. | |
| 2007/0127941 | A1 | 6/2007 | Ishii et al. | |
| 2007/0134014 | A1 | 6/2007 | Kato et al. | |
| 2009/0190946 | A1* | 7/2009 | Ai | 399/66 |
| 2010/0008687 | A1 | 1/2010 | Ishii | |
| 2010/0098446 | A1 | 4/2010 | Ishikawa et al. | |
| 2011/0229168 | A1 | 9/2011 | Shiraishi et al. | |
| 2012/0008991 | A1 | 1/2012 | Shimizu | |
| 2012/0045231 | A1 | 2/2012 | Ogino et al. | |
| 2012/0045237 | A1 | 2/2012 | Aoki et al. | |
| 2012/0045259 | A1 | 2/2012 | Nakamura et al. | |
| 2012/0170951 | A1 | 7/2012 | Ishii | |
| 2012/0230715 | A1 | 9/2012 | Ogino et al. | |
| 2012/0308250 | A1* | 12/2012 | Shimizu et al. | 399/66 |
| 2013/0136468 | A1 | 5/2013 | Shimizu et al. | |
| 2013/0195483 | A1 | 8/2013 | Shimizu et al. | |

FOREIGN PATENT DOCUMENTS

| | | | |
|---|---|---|---|
| JP | 08-166727 | | 6/1996 |
| JP | 09-138588 | | 5/1997 |
| JP | 9-146381 | | 6/1997 |
| JP | 2000-112298 | | 4/2000 |
| JP | 2001-175096 | A | 6/2001 |
| JP | 2001-324850 | | 11/2001 |
| JP | 2006-30980 | A | 2/2006 |
| JP | 2006-267486 | | 10/2006 |
| JP | 2008-058585 | | 3/2008 |
| JP | 2008-185890 | | 8/2008 |
| JP | 2009-258429 | A | 11/2009 |
| JP | 2010-091806 | A | 4/2010 |

OTHER PUBLICATIONS

Office Action issued Sep. 12, 2014 in Japanese Patent Application No. 2011-283112.

Office Action issued on Aug. 7, 2015 in Japanese Patent Application No. 2014-228600.

Office Action mailed Oct. 23, 2015 in Japanese Patent Application No. 2014-228600.

* cited by examiner

FIG. 13

| NUMBER OF PRINTS | COMPARATIVE EXAMPLE 1 | EMBODIMENT 1 |
|---|---|---|
| 0 | GOOD | GOOD |
| 10000 | GOOD | GOOD |
| 20000 | GOOD | GOOD |
| 30000 | GOOD | GOOD |
| 40000 | GOOD | GOOD |
| 50000 | GOOD | GOOD |
| 60000 | GOOD | GOOD |
| 70000 | GOOD | GOOD |
| 80000 | GOOD | GOOD |
| 90000 | GOOD | GOOD |
| 100000 | POOR | GOOD |
| 110000 | POOR | GOOD |
| 120000 | POOR | GOOD |

FIG. 14

| NUMBER OF PRINTS | COMPARATIVE EXAMPLE 2 | EMBODIMENT 2 | EMBODIMENT 3 |
|---|---|---|---|
| 0 | 5 | 5 | 5 |
| 10000 | 5 | 5 | 5 |
| 20000 | 5 | 5 | 5 |
| 30000 | 4 | 5 | 5 |
| 40000 | 4 | 5 | 5 |
| 50000 | 4 | 5 | 5 |
| 60000 | 4 | 5 | 5 |
| 70000 | 3 | 5 | 5 |
| 80000 | 3 | 5 | 5 |
| 90000 | 2 | 4 | 5 |
| 100000 | 2 | 4 | 5 |

IMAGE FORMING APPARATUS AND TRANSFER BIAS APPLICATION DEVICE THEREIN

CROSS-REFERENCE TO RELATED APPLICATIONS

This patent application is a continuation of U.S. patent application Ser. No. 13/718,395 filed Dec. 18, 2012, which is based on and claims priority pursuant to 35 U.S.C. §119 to Japanese Patent Application No. 2011-283112, filed on Dec. 26, 2011, in the Japan Patent Office, the entire disclosure of which is hereby incorporated by reference herein.

BACKGROUND OF THE INVENTION

1. Field of the Invention

Exemplary aspects of the present invention generally relate to an image forming apparatus, such as a copier, a facsimile machine, a printer, or a multi-functional system including a combination thereof.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photoconductive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

In known electrophotographic image forming apparatuses, toner images of yellow, magenta, cyan, and black are formed on photosensitive drums of the respective colors. The image forming apparatus using an intermediate transfer method employs a belt-type intermediate transfer member (hereinafter refers to simply as intermediate transfer belt) formed into an endless loop that contacts the photosensitive drums, forming a primary transfer nip therebetween. In the primary transfer nip, a toner image formed on the photosensitive drum is transferred primarily onto the intermediate transfer belt. This process is known as a "primary transfer process".

A secondary transfer roller contacts a peripheral surface of the intermediate transfer belt, forming a secondary transfer nip therebetween, so that the toner image on the intermediate transfer belt is secondarily transferred onto a recording medium in a process known as "secondary transfer process". A secondary transfer opposed roller is disposed inside the loop formed by the intermediate transfer belt, facing the secondary transfer roller with the intermediate transfer belt interposed therebetween. The secondary transfer opposed roller disposed inside the loop of the intermediate transfer belt is grounded. By contrast, the secondary transfer roller disposed outside the loop is supplied with a secondary transfer bias. With this configuration, a secondary transfer electric field causing the toner image to move electrostatically from the secondary transfer opposed roller side to secondary transfer roller side is formed. The toner image on the intermediate transfer belt is transferred secondarily onto a recording medium fed to the secondary transfer nip in appropriate timing such that the recording medium is aligned with the toner image formed on the intermediate transfer belt.

When using a recording medium having a coarse surface such as Japanese paper, a pattern of light and dark according to the surface condition of the recording medium appears in an output image. More specifically, toner does not transfer well to such embossed surfaces, in particular recessed portions of the surface. This inadequate transfer of the toner appears as a pattern of light and dark patches in the resulting output image.

In view of the above, in a known image forming apparatus, instead of using a secondary transfer bias composed only of a direct current (DC) voltage, a bias in which an alternating current (AC) voltage is superimposed on a DC voltage is supplied as a secondary transfer bias, thereby preventing the pattern of light and dark. Such a secondary transfer bias causes the toner to move back and forth between the recessed portions of the recording medium and the image bearing member such as the intermediate transfer belt. Accordingly, the toner contacts the recessed portions of the recording medium, preventing improper transfer of toner. In this configuration, generation of a pattern of light and dark patches is suppressed, as compared with using the secondary transfer bias including the DC voltage only.

The superimposed bias in which the AC component is superimposed on the DC component is used as a transfer bias not only to prevent generation of the pattern of light and dark.

For example, in another known image forming apparatus, the transfer bias including the AC component superimposed on the DC component is used during double sided printing to prevent unevenness of transfer, dropouts of toner, and improper transfer of toner to a non-image formation area of a recording medium. In this configuration, a peak-to-peak voltage of the AC component is equal to or less than twice the absolute value of the DC component.

In another example, the superimposed bias including the AC component superimposed on the DC voltage is used together with an intermediate transfer member with a fluorocarbon resin surface to prevent generation of blank spots in an output image, which often happens in the intermediate transfer method. In this configuration, the peak-to-peak voltage of the AC component is equal to or greater than 2.05 times the DC component.

The superimposed bias is used also to prevent a partial toner transfer failure in character images or line images. In this case, the frequency of the AC component is equal to or less than 4 kHz and the number of cycles is 20 cycles or more.

Although advantageous and generally effective for its intended purpose, there is a drawback of using the superimposed bias with the AC component superimposed on the DC component in that the superimposed bias promotes degradation of parts such as the transfer member and shortens the life of these parts, which is not the case with the transfer bias using the DC component only.

When applying the secondary transfer bias including the superimposed bias having the peak-to-peak voltage of the AC component substantially greater than the absolute value of the DC component, for example, four times greater than the absolute value of the DC component, the toner can be transferred adequately to the recessed portions of the recording medium having a rough surface, and hence a desired image density can be obtained. The pattern of light and dark patches is prevented from appearing on the output image. Although advantageous, because the peak-to-peak voltage of the AC component of the secondary transfer bias is significantly higher, for example, four times greater than the absolute value of the DC component, the AC component promotes degradation of the transfer member.

In view of the above, there is demand for an image forming apparatus that is capable of preventing degradation of parts even when the transfer bias includes the AC component superimposed on the DC component.

SUMMARY OF THE INVENTION

In view of the foregoing, in an aspect of this disclosure, there is provided an improved image forming apparatus including an image bearing member, a transfer member, a transfer bias application device, and a controller. The image bearing member rotates and bears a toner image on a surface thereof. The transfer member is disposed facing the image bearing member to form a transfer region therebetween. The transfer bias application device applies to the transfer region a transfer bias including a direct current (DC) component and an alternating current (AC) component to transfer the toner image onto the recording medium as the recording medium passes through the transfer region. The controller is operatively connected to the transfer bias application device to control the transfer bias application device such that during a bias change period in a sheet absent period in which the image bearing member rotates and no recording medium passes through the transfer region, the transfer bias application device selectively applies to the transfer region one of the transfer bias without the AC component and the transfer bias with a peak-to-peak voltage of the AC component less than that applied in image formation.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 13 is a table showing results of a first experiment; and

FIG. 14 is a table showing results of a second experiment.

DETAILED DESCRIPTION OF THE INVENTION

Figure 1:
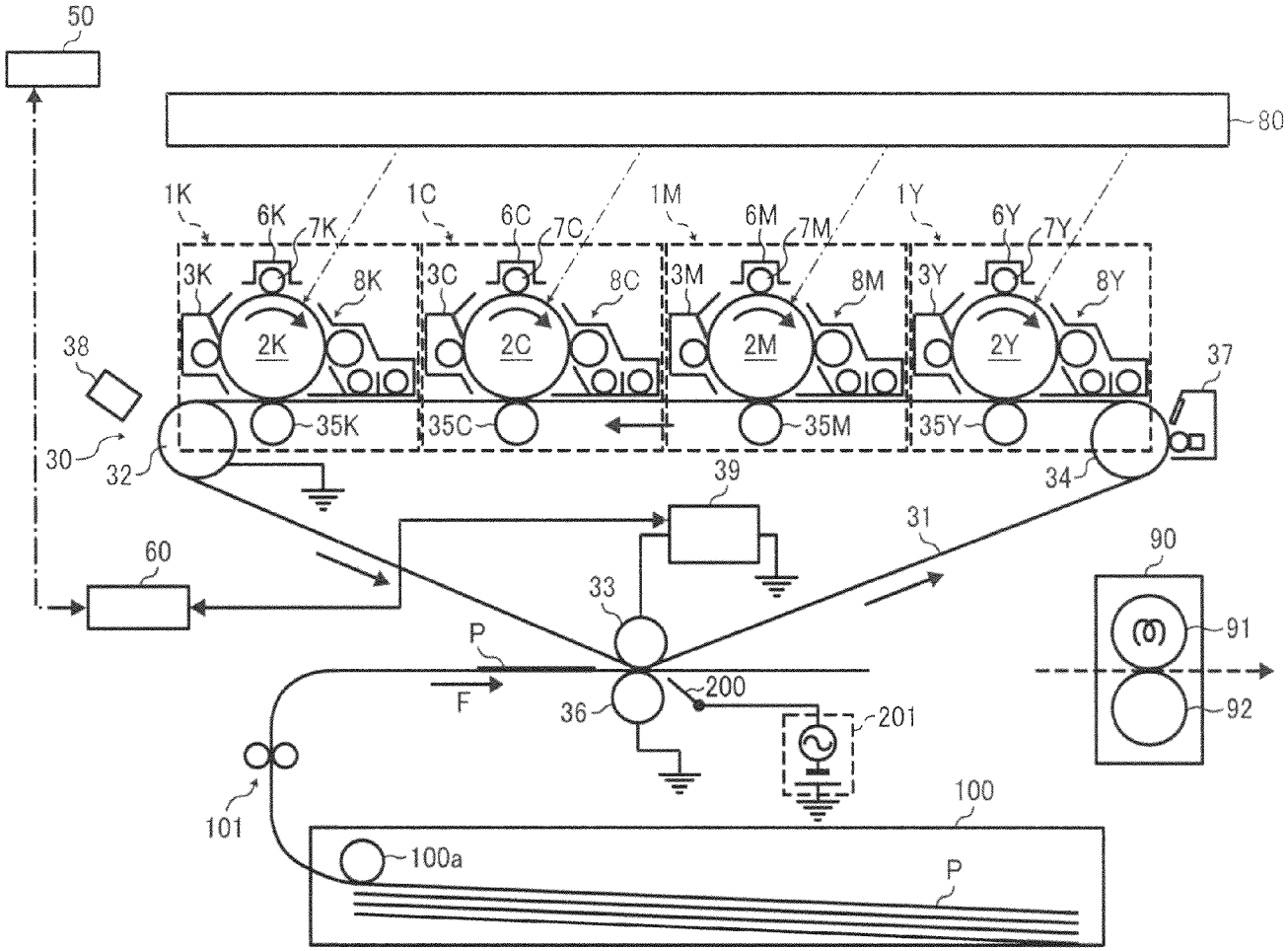
FIG. 1 is a schematic diagram illustrating a printer as an example of an image forming apparatus according to an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, a description is provided of an image forming apparatus according to an aspect of this disclosure.

With reference to FIG. 1, a description is provided of an electrophotographic color printer according to an illustrative embodiment of the present invention. FIG. 1 is a schematic diagram illustrating a color printer as an example of the image forming apparatus.

As illustrated in FIG. 1, the image forming apparatus includes a control panel 50 and a controller 60. Users can instruct desired operations through the control panel 50 and/or confirm information shown on a screen of the control panel 50. The control panel 50 includes a touch panel and a plurality of key buttons. The control panel 50 can show an image on a screen of the touch panel, and receives an instruction input by the user on the touch panel or the key buttons. The control panel 50 is connected to the controller 60 of the image forming apparatus. The control panel 50 can display on the touch panel an image based on a control signal provided by the controller 60.

As illustrated in FIG. 1, the image forming apparatus includes four image forming units 1Y, 1M, 1C, and 1K for forming toner images, one for each of the colors yellow, magenta, cyan, and black, respectively, a transfer unit 30 serving as a transfer device, an optical writing unit 80, a fixing device 90, a sheet cassette 100, and a pair of registration rollers 101. The arrangement of image forming units 1Y, 1M, 1C, and 1K is not limited to this order. It is to be noted that the suffixes Y, M, C, and K denote colors yellow, magenta, cyan, and black, respectively. To simplify the description, these suffixes Y, M, C, and K indicating colors are omitted herein, unless otherwise specified.

The optical writing unit 80 is disposed substantially above the image forming units 1Y, 1M, 1C, and 1K. The sheet cassette 100 is disposed at the bottom of the image forming apparatus. The fixing device 90 is disposed downstream from the transfer unit 30 in the direction of transport of the recording medium indicated by a hollow arrow.

The image forming units 1Y, 1M, 1C, and 1K include photosensitive drums 2Y, 2M, 2C, and 2K (which may be referred to collectively as photosensitive drums 2), respectively. The image forming units 1Y, 1M, 1C, and 1K can be replaced upon reaching their product life cycles. The image forming units 1Y, 1M, 1C, and 1K all have the same configuration as all the others, differing only in the color of toner employed. Thus, a description is provided of the image forming unit 1K for forming a toner image of black as a representative example of the image forming units 1.

Figure 2:
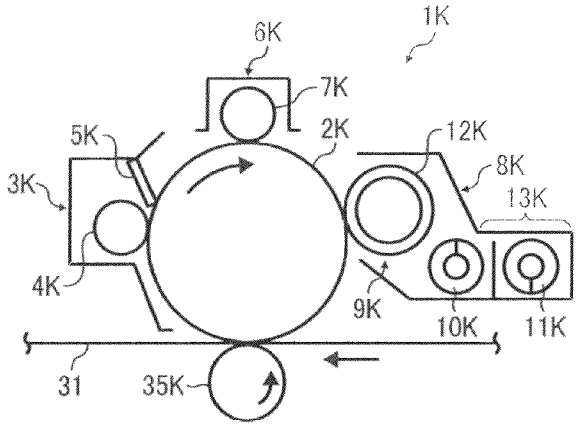
FIG. 2 is a schematic diagram illustrating an image forming unit for black as an example of image forming units employed in the image forming apparatus of FIG. 1.

With reference to FIG. 2, a description is provided of the image forming unit 1K as an example of the image forming units. FIG. 2 is a schematic diagram illustrating the image forming unit 1K. A photosensitive drum 2K serving as a latent image bearing member is surrounded by various pieces of imaging equipment, such as a charging device 6K, a developing device 8K, a drum cleaner 3K, and a charge neutralizer (not illustrated). These devices are held by a common holder so that they are detachably attachable and replaced at the same time. Similar to the photosensitive drum 2K, the photosensitive drums 2C, 2M, and 2Y are also surrounded by charging devices 6C, 6M, and 6Y including charging rollers 7C, 7M, and 7Y, developing devices 8C, 8M, and 8Y, and drum cleaners 3C, 3M, and 3Y (shown in FIG. 1).

The photosensitive drum 2K comprises a drum-shaped base on which an organic photoconductive layer is disposed, with the external diameter of approximately 60 mm. The photosensitive drum 2K is rotated by a driving device in a clockwise direction indicated by an arrow. The charging device 6K includes a charging roller 7K supplied with a charging bias. The charging roller 7K contacts or is disposed close to the photosensitive drum 2K to generate electric discharge therebetween, thereby charging uniformly the surface of the photosensitive drum 2K. According to the present illustrative embodiment, the photosensitive drum 2K is uniformly charged with a negative polarity which is the same polarity as the normal charge on toner.

As the charging bias, an alternating current (AC) voltage superimposed on a direct current (DC) voltage is employed. The charging roller 7K comprises a metal core coated with a conductive elastic layer made of a conductive elastic material. According to the present embodiment, the photosensitive drum 2K is charged by the charging roller 7K which contacts the photosensitive drum 2K or is disposed near the photosensitive drum 2K. Alternatively, a corona charger may be employed.

The uniformly charged surface of the photosensitive drum 2K is scanned by a light beam projected from the optical writing unit 80, thereby forming an electrostatic latent image for black on the surface of the photosensitive drum 2K. The electrostatic latent image for black on the photosensitive drum 2K is developed with black toner by the developing device 8K. Accordingly, a visible image, also known as a toner image of black, is formed on the photosensitive drum 2K. Subsequently, as will be described later, the toner image is transferred primarily onto an intermediate transfer belt 31 in the process known as a primary transfer process.

The drum cleaner 3K removes residual toner remaining on the photosensitive drum 2K after the primary transfer process, that is, after the photosensitive drum 2K passes through a primary transfer nip at which the photosensitive drum 2K contacts the intermediate transfer belt 31. The drum cleaner 3K includes a brush roller 4K and a cleaning blade 5K. The cleaning blade 5K is cantilevered, that is, one end of the cleaning blade is fixed to the housing of the drum cleaner 3K, and its free end contacts the surface of the photosensitive drum 2K. The brush roller 4K rotates and brushes off the residual toner from the surface of the photosensitive drum 2K while the cleaning blade 5K removes the residual toner by scraping. It is to be noted that the cantilevered side of the cleaning blade 5K is positioned downstream from its free end contacting the photosensitive drum 2K in the direction of rotation of the photosensitive drum 2K so that the free end of the cleaning blade 5K faces or becomes counter to the direction of rotation.

The charge neutralizer removes residual charge remaining on the photosensitive drum 2K after the surface thereof is cleaned by the drum cleaner 3K in preparation for the subsequent imaging cycle. Accordingly, the surface of the photosensitive drum 2K is initialized.

The developing device 8K includes a developing portion 12K and a developer conveyer 13K. The developing portion 12K includes a developing roller 9K inside thereof. The developer conveyer 13K mixes a developing agent for black and transports the developing agent. The developer conveyer 13K includes a first chamber equipped with a first screw 10K and a second chamber equipped with a second screw 11K. The first screw 10K and the second screw 11K are each constituted of a rotatable shaft and helical fighting wrapped around the circumferential surface of the shaft. Each end of the shaft of the first screw 10K and the second screw 11K in the axial direction is rotatably held by shaft bearings.

The first chamber with the first screw 10K and the second chamber with the second screw 11K are separated by a wall, but each end of the wall in the direction of the screw shaft has a connecting hole through which the first chamber and the second chamber are connected. The first screw 10K mixes the developing agent by rotating the helical flighting and carries the developing agent from the distal end to the proximal end of the screw in the direction perpendicular to the surface of the recording medium in FIG. 2 while rotating. The first screw 10K is disposed parallel to and facing the developing roller 9K. The developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K passes through the connecting hole in the wall near the proximal side and enters the second chamber. Subsequently, the developing agent is carried by the helical flighting of the second screw 11K. As the second screw 11K rotates, the developing agent is transported from the proximal end to the distal end while being mixed in the direction of rotation.

In the second chamber, a toner density detector for detecting the density of toner in the developing agent is disposed at the bottom of a casing of the chamber. As the toner density detector, a magnetic permeability detector is employed. There is a correlation between the toner density and the magnetic permeability of the developing agent consisting of toner and a magnetic carrier. Therefore, the magnetic permeability detector can detect the density of the toner.

Although not illustrated, the image forming apparatus includes toner supply devices to supply independently toner of yellow, magenta, cyan, and black to the second chamber of the respective developing device 8. The controller 60 of the image forming apparatus includes a Random Access Memory (RAM) to store a target value Vtref for output voltages provided by the toner density detectors for yellow, magenta, cyan, and black. If a difference between the output voltage provided by the toner density detectors and the target value Vtref exceeds a predetermined value, the toner supply devices are activated, and the respective color of toner is supplied to the second chamber of the developing device 8K.

The developing roller 9K in the developing portion 12K faces the first screw 10K as well as the photosensitive drum 2K through an opening formed in the casing of the developing device 8K. The developing roller 9K comprises a cylindrical developing sleeve made of a non-magnetic pipe which is rotated, and a magnetic roller disposed inside the developing sleeve. The magnetic roller is fixed to prevent the magnetic roller from rotating together with the developing sleeve. The developing agent supplied from the first screw 10K is carried on the surface of the developing sleeve due to the magnetic force of the magnetic roller. As the developing sleeve rotates, the developing agent is transported to a developing area facing the photosensitive drum 2K.

The developing sleeve is supplied with a developing bias having the same polarity as the toner. The potential of the developing bias is greater than that of the electrostatic latent image on the photosensitive drum 2K, but less than the charging potential of the uniformly charged photosensitive drum 2K. With this configuration, a developing potential that causes the toner on the developing sleeve to move electrostatically to the electrostatic latent image on the photosensitive drum 2K acts between the developing sleeve and the electrostatic latent image on the photosensitive drum 2K. A non-developing potential acts between the developing sleeve and a background portion (a non-image formation area) of the photosensitive drum 2K, causing the toner on the developing sleeve to move to the sleeve surface. Due to the developing potential and the non-developing potential, the toner on the developing sleeve moves selectively to the electrostatic latent image formed on the photosensitive drum 2K, thereby forming a visible image, known as a toner image on the surface of the photosensitive drum 2K.

Similar to the image forming unit 1K, in the image forming units 1Y, 1M, and 1C, toner images of yellow, magenta, and cyan are formed on the photosensitive drums 2Y, 2M, and 2C, respectively.

The optical writing unit 80 for writing a latent image on the photosensitive drums 2 is disposed above the image forming units 1Y, 1M, 1C, and 1K. Based on image information received from external devices such as a personal computer (PC), the optical writing unit 80 illuminates the photosensitive drums 2Y, 2M, 2C, and 2K with a light beam indicated by dotted arrows in FIG. 1 (L1 in FIG. 12) projected from a light source such as a laser diode of the optical writing unit 80. Accordingly, the electrostatic latent images of yellow, magenta, cyan, and black are formed on the photosensitive drums 2Y, 2M, 2C, and 2K, respectively. More specifically, the potential of the portion of the charged surface of the photosensitive drum 2 illuminated with the light beam is attenuated. The potential of the illuminated portion of the photosensitive drum 2 is less than the potential of the other area, that is, the background portion (non-image formation area), thereby forming the electrostatic latent image on the photosensitive drum 2.

The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photosensitive drum 2. Alternatively, the optical writing unit 80 may employ a light source using an LED array including a plurality of LEDs that projects light.

Still referring to FIG. 1, a description is provided of the transfer unit 30. The transfer unit 30 is disposed below the image forming units 1Y, 1M, 1C, and 1K. The transfer unit 30 includes the intermediate transfer belt 31 serving as an image bearing member formed into an endless loop and entrained about a plurality of rollers, thereby rotating endlessly in the counterclockwise direction indicated by hollow arrows. The transfer unit 30 also includes a driving roller 32, a secondary transfer opposed roller 33, a cleaning auxiliary roller 34, a belt cleaner 37, four primary transfer rollers 35Y, 35M, 35C, and 35K, a secondary transfer roller 36 serving as a transfer member, a density detector 38 serving as a toner adherence detector, and so forth.

The intermediate transfer belt 31 is entrained around and stretched taut between the driving roller 32, the secondary transfer opposed roller 33, the cleaning auxiliary roller 34, and the primary transfer rollers 35Y, 35M, 35C, and 35K (hereinafter collectively referred to as the primary transfer rollers 35, unless otherwise specified). The driving roller 32 is rotated in the counterclockwise direction by a motor or the like, and rotation of the driving roller 32 enables the intermediate transfer belt 31 to rotate in the same direction.

The intermediate transfer belt 31 is made of resin such as polyimide resin in which carbon black is dispersed. The intermediate transfer belt 31 has a thickness in a range of from approximately 20 μm to 200 μm, preferably, approximately 60 μm. The volume resistivity thereof is in a range of from $10^6$ [Ω·cm] to $10^{12}$ [Ω·cm], preferably, approximately $10^9$ [Ω·cm]. The volume resistivity thereof is measured with an applied voltage of 100 V by a high resistivity meter, Hiresta UPMCPHT 45 manufactured by Mitsubishi Chemical Corporation. The volume resistivity thereof is measured with an applied voltage of 100 V by a high resistivity meter, Hiresta UPMCPHT 45 manufactured by Mitsubishi Chemical Corporation.

The intermediate transfer belt 31 is interposed between the photosensitive drums 2Y, 2M, 2C, and 2K, and the primary transfer rollers 35Y, 35M, 35C, and 35K. Accordingly, the primary transfer nips are formed between the front surface or an image bearing surface of the intermediate transfer belt 31 and each of the photosensitive drums 2Y, 2M, 2C, and 2K. A primary transfer bias is applied to the primary transfer rollers 35Y, 35M, 35C, and 35K by a transfer bias power source. Accordingly, a primary transfer electric field is formed between the primary transfer rollers 35Y, 35M, 35C, and 35K, and the toner images of yellow, magenta, cyan, and black formed on the photosensitive drums 2Y, 2M, 2C, and 2K.

The toner image Y for yellow formed on the photosensitive drum 2Y enters the primary transfer nip as the photosensitive drum 2Y rotates. Subsequently, the toner image is transferred from the photosensitive drum 2Y to the intermediate transfer belt 31 due to the transfer electric field and the nip pressure. As the intermediate transfer belt 31, on which the toner image of yellow has been transferred, passes through the primary transfer nips of magenta, cyan, and black, the toner images on the photosensitive drums 2M, 2C, and 2K are superimposed on the toner image of yellow, thereby forming a composite toner image on the intermediate transfer belt 31 in the primary transfer process. With this configuration, a color composite toner image is formed on the intermediate transfer belt 31 in the primary transfer process.

Each of the primary transfer rollers 35Y, 35M, 35C, and 35K is constituted of a metal core and a conductive sponge layer fixated on the metal core. The outer diameter of the primary transfer rollers 35Y, 35M, 35C, and 35K is approximately 16 mm, and the diameter of the metal core thereof is approximately 10 mm. The electric resistance of the sponge layer is approximately $3\times10^7$.

The resistance R of the sponge layer is measured such that a metal roller having an outer diameter of 30 mm is grounded and pressed against the sponge layer at a load of 10 N, and a voltage of 1000 V is supplied to the metal core of the primary transfer roller 35. The resistance R is obtained by Ohm's law R=V/I, where V is a voltage, I is a current that flows in the metal core, and R is a resistance. According to the present illustrative embodiment, the primary transfer rollers 35Y, 35M, 35C, and 35K described above are supplied with a primary transfer bias through constant current control.

According to the present illustrative embodiment, a roller-type primary transfer member is used as the primary transfer roller 35. Alternatively, any other suitable charger such as a transfer charger and a brush-type transfer member may be employed as a primary transfer member.

The secondary transfer roller 36 of the transfer unit 30 is disposed outside the loop formed by the intermediate transfer belt 31, opposite the secondary transfer opposed roller 33 which is disposed inside the looped intermediate transfer belt 31. The intermediate transfer belt 31 is interposed between the secondary transfer roller 36 and the secondary transfer opposed roller 33. Accordingly, the peripheral surface or the image bearing surface of the intermediate transfer belt 31 contacts the secondary transfer roller 36 serving also as a nip forming roller, thereby forming a secondary transfer nip therebetween. The secondary transfer roller 36 is grounded. By contrast, a secondary transfer power source 39 applies a secondary transfer bias to the secondary transfer opposed roller 33. With this configuration, a secondary transfer electric field is formed between the secondary transfer opposed roller 33 and the secondary transfer roller 36 so that the toner having a negative polarity is transferred electrostatically from the secondary transfer opposed roller side to the secondary transfer roller side.

As illustrated in FIG. 1, the sheet cassette 100 storing a stack of recording media sheets P is disposed below the transfer unit 30. The sheet cassette 100 is equipped with a sheet feed roller 100*a* to contact a top sheet of the stack of recording media sheets P. As the sheet feed roller 100*a* is rotated at a predetermined speed, the sheet feed roller 100*a* picks up the top sheet of the recording medium P and sends it to a sheet passage. Substantially at the end of the sheet passage, a pair of registration rollers 101 is disposed. The pair of the registration rollers 101 stops rotating temporarily as soon as the recording medium P is interposed therebetween. The pair of registration rollers 101 starts to rotate again to feed the recording medium P to the secondary transfer nip in appropriate timing such that the recording medium P is aligned with the composite toner image formed on the intermediate transfer belt 31 in the secondary transfer nip.

In the secondary transfer nip, the recording medium P tightly contacts the composite toner image on the intermediate transfer belt 31, and the composite toner image is transferred onto the recording medium P due to the secondary transfer electric field and the nip pressure applied thereto. The recording medium P on which the composite color toner image is formed passes through the secondary transfer nip and separates from the secondary transfer roller 36 and the intermediate transfer belt 31 by self-stripping.

The secondary transfer opposed surface roller 33 is formed of a metal core on which a conductive nitrile rubber (NBR) layer is disposed. The outer diameter of the secondary transfer opposed roller 33 is approximately 24 mm. The diameter of the metal core is approximately 16 mm. The resistance R of the conductive NBR rubber layer is equal to or greater than $1\times10^6\Omega$, but equal to or less than $1\times10^{12}\Omega$, preferably approximately $4\times10^7\Omega$. The resistance of the NBR rubber layer is measured using the same method as the primary transfer roller 35 described above.

Similar to the secondary transfer opposed roller 33, the secondary transfer roller 36 includes a metal core on which the NBR rubber layer is disposed. According to the present illustrative embodiment, the outer diameter of the secondary transfer roller 36 is approximately 24 mm. The diameter of the metal core is approximately 14 mm. The resistance of the NBR rubber layer is equal to or less than $1\times10^6\Omega$. The resistance of the NBR rubber layer is measured using the same method as the primary transfer roller 35 described above.

The secondary transfer power source 39 serving as a transfer bias application device includes a direct current (DC) power source and an alternating current (AC) power source, and can apply to the secondary transfer nip an alternating voltage in which an AC voltage (AC component) superimposed on a DC voltage (DC component) as the secondary transfer bias. It is to be noted that the secondary transfer power source 39 can operate constant current control. An output terminal of the secondary transfer power source 39 is connected to the metal core of the secondary transfer opposed roller 33. The potential of the metal core of the secondary transfer opposed roller 33 has almost the same value as the output voltage of the secondary transfer power source 39.

As illustrated in FIG. 1, a sheet separation device 200 is disposed downstream from the secondary transfer nip in the direction of transport of the recording medium (at the right side in FIG. 1). According to the present illustrative embodiment, the sheet separation device 200 includes a charge eliminating needle having a serrated shape. The reference numeral 201 refers to a power source for the sheet separation device.

According to the present illustrative embodiment, the secondary transfer roller 36 is grounded while the secondary transfer bias including the alternating voltage is applied to the secondary transfer opposed roller 33. Alternatively, the secondary transfer opposed roller 33 may be grounded while the secondary transfer bias including the alternating voltage is applied to the secondary transfer roller 36. In this case, the polarity of the DC voltage is changed. More specifically, as illustrated in FIG. 2, in a case in which the superimposed bias is applied to the secondary transfer opposed roller 33 while toner having a negative polarity is used and the secondary transfer roller 36 is grounded, the DC voltage having the same negative polarity as the toner is used so that a time-averaged potential of the superimposed bias has the same negative polarity as the toner.

By contrast, when the secondary transfer opposed roller 33 is grounded and the secondary transfer bias is applied to the secondary transfer roller 36, the DC voltage having the positive polarity, which is opposite that of the toner, is used so that the time-averaged value of the secondary transfer bias has the positive polarity opposite that of the toner.

Instead of applying the secondary transfer bias including the alternating voltage to the secondary transfer roller 36 or to the secondary transfer opposed roller 33, the DC voltage is supplied to one of the secondary transfer roller 36 and the secondary transfer opposed roller 33, and the AC voltage is supplied to another of the secondary transfer roller 36 and the secondary transfer opposed roller 33.

When using a normal sheet of paper, such as the one having a relatively smooth surface, a pattern of dark and light according to the surface conditions of the recording medium is less likely to appear on the recording medium. In this case, the transfer bias including only the DC voltage can be supplied. By contrast, when using a recording medium having a rough surface such as pulp paper, the transfer bias needs to be changed from the transfer bias including only the DC voltage to the alternating voltage described above.

After the intermediate transfer belt 31 passes through the secondary transfer nip, residual toner not having been transferred onto the recording medium remains on the intermediate transfer belt 31. The residual toner is removed from the intermediate transfer belt 31 by the belt cleaning device 37 which contacts the surface of the intermediate transfer belt 31. The cleaning auxiliary roller 34 disposed inside the loop formed by the intermediate transfer belt 31 supports cleaning operation by the belt cleaning device 37 from inside the loop of the intermediate transfer belt 31 so that the residual toner on the intermediate transfer belt 31 is removed reliably.

The density detector 38 faces the intermediate transfer belt 31 entrained around the driving roller 32 with a gap of approximately 4 mm between the density detector 38 and the intermediate transfer belt 31. An amount of toner adhered to the toner image primarily transferred onto the intermediate transfer belt 31 is measured when the toner image comes to the position opposite the density detector 38.

On the right side of the secondary transfer nip between the secondary transfer roller 36 and the intermediate transfer belt 31, the fixing device 90 is disposed. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording medium P bearing an unfixed toner image on the surface thereof is delivered to a fixing nip at which the pressing roller 92 presses against the fixing roller 91 in the fixing device 90. Under heat and pressure, the toner adhered to the toner image is softened and fixed to the recording medium P in the fixing nip. After the toner image affixed to the recording medium P, the recording medium P is output from the fixing device 90. Subsequently, the recording medium P is delivered outside the image forming apparatus from the fixing device 90 along the sheet passage.

In the case of monochrome imaging, a support plate supporting the primary transfer rollers 35Y, 35M, and 35C of the transfer unit 30 is moved to separate the primary transfer rollers 35Y, 35M, and 35C from the photosensitive drums 2Y, 2M, and 2C. Accordingly, the front surface of the intermediate transfer belt 31, that is, the image bearing surface, is separated from the photosensitive drums 2Y, 2M, and 2C so that the intermediate transfer belt 31 contacts only the photosensitive drum 2K for black color. In this state, only the image forming unit 1K is activated to form a toner image of black on the photosensitive drum 2K.

Figure 3:
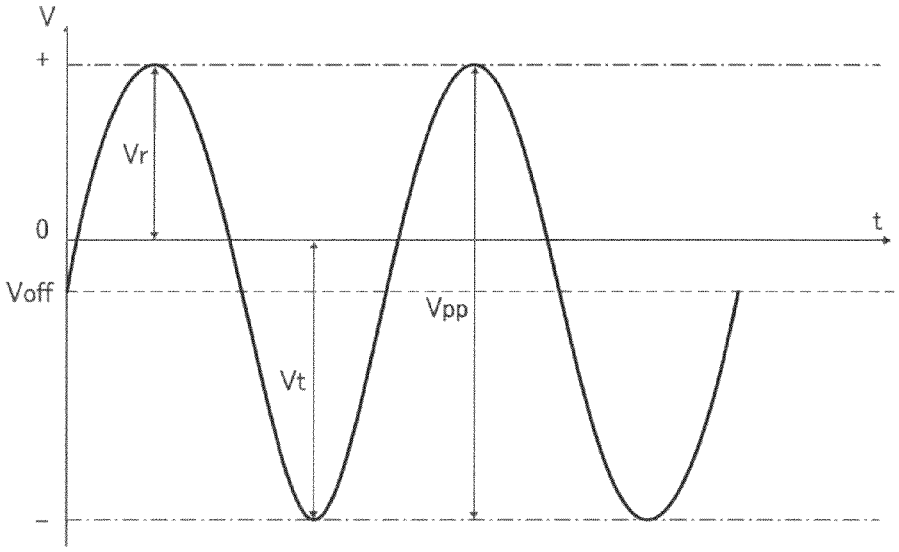
FIG. 3 is a waveform chart showing an example of a waveform of a secondary transfer bias provided by a secondary transfer power source employed in the image forming apparatus.

With reference to FIG. 3, a description is provided of the secondary transfer bias output from the secondary transfer power source 39. FIG. 3 shows an example of a waveform of the secondary transfer bias.

The secondary transfer power source 39 serves as a transfer bias application device and applies an output voltage to the metal core of the secondary transfer opposed roller 33. Accordingly, the secondary transfer bias is applied between the metal core of the secondary transfer roller 36 which is grounded and the metal core of the secondary transfer opposed roller 33.

According to the present illustrative embodiment, a value obtained by subtracting the potential of the metal core of the secondary transfer roller 36 from the potential of the metal core of the secondary transfer opposed roller 33 serves as the secondary transfer bias. Since the metal core of the secondary transfer roller 36 is substantially 0 (zero) V, the secondary transfer bias is substantially similar to or coincides with the output voltage of the secondary transfer power source 39.

As described above, the secondary transfer bias includes the AC component superimposed on the DC component, and the time-averaged value thereof is configured to have a negative polarity when using toner having a negative polarity which is a normal charging polarity. This means that the potential of the secondary transfer roller 36 is greater than the secondary transfer opposed roller 33 towards the polarity (here, the positive side) opposite to the normal charging polarity of the toner. Accordingly, the toner adhered to the outer circumferential surface of the intermediate transfer belt 31 is electrostatically moved to the secondary transfer roller side.

In FIG. 3, an offset voltage Voff is a value of the DC component of the secondary transfer bias. A peak-to-peak voltage Vpp is a peak-to-peak voltage of the AC component of the secondary transfer bias. According to the present illustrative embodiment, the AC component has a sinusoidal waveform. The offset voltage Voff coincides with the time-averaged value of the AC component. Alternatively, the offset voltage Voff of the secondary transfer bias may have an asymmetric waveform in which the offset voltage Voff does not coincide with the time-averaged value of the AC component.

According to the present illustrative embodiment, the secondary transfer bias includes an alternating voltage in which a transfer voltage and a returning voltage are alternately inverted when transferring secondarily the toner image from the intermediate transfer belt 31 to the recording medium P. The transfer voltage herein refers to a voltage having a polarity (in the present illustrative embodiment, a negative polarity) in the transfer direction in which the toner image on the intermediate transfer belt 31 is transferred onto the recording medium P. The returning voltage has a polarity (in the present illustrative embodiment, a positive polarity) opposite that of the transfer voltage.

According to the present illustrative embodiment, the time-averaged value of the secondary transfer voltage has a polarity in the transfer direction, for example, a negative polarity, that causes the toner image on the intermediate transfer belt 31 to move to the recording medium P. With application of such a secondary transfer bias, if the polarity of the secondary transfer bias is negative so is the polarity of the toner (that is, when the transfer voltage is applied), the toner having a negative polarity is pushed electrostatically from the secondary transfer opposed roller side towards the secondary transfer roller side in the secondary transfer nip. Accordingly, the toner on the intermediate transfer belt 31 is transferred onto the recording medium P.

By contrast, if the secondary transfer voltage has a polarity opposite that of the toner, that is, the polarity of the secondary transfer voltage is positive (in other words, when the returning voltage is applied), the toner having the negative polarity is attracted electrostatically to the secondary transfer opposed roller side from the secondary transfer roller side in the secondary transfer nip. Consequently, the toner transferred to the recording medium P is attracted again to the intermediate transfer belt 31.

Next, a description is provided of behavior of toner in the secondary transfer nip.

Figure 4:
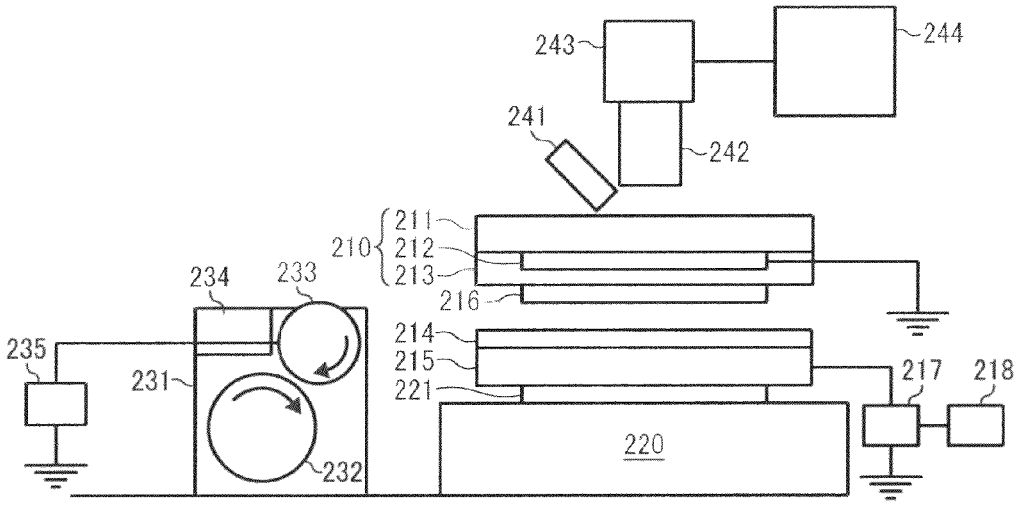
FIG. 4 is a schematic diagram illustrating an observation equipment for observation of behavior of toner in a secondary transfer nip.

The present inventors performed observation experiments using special observation equipment shown in FIG. 4. FIG. 4 is a schematic diagram illustrating the observation equipment for observation of behavior of toner in the secondary transfer nip.

The observation equipment includes a transparent substrate 210, a metal plate 215, a substrate 221, a developing device 231, a power source 235, a Z stage 220, a light source 241, a microscope 242, a high-speed camera 243, a personal computer 244, a voltage amplifier 217, a waveform generator 218, and so forth. The transparent substrate 210 includes a glass plate 211, a transparent electrode 212 made of Indium Tin Oxide (ITO) and disposed on a lower surface of the glass plate 211, and a transparent insulating layer 213 made of a transparent material covering the transparent electrode 212. The transparent substrate 210 is supported at a predetermined height position by a substrate support. The substrate support is allowed to move in the vertical as well as the horizontal directions in the drawing by a moving assembly. In the illustrated example shown in FIG. 4, the transparent substrate 210 is located above the Z stage 220 having the metal plate 215 placed thereon. The transparent substrate 210 is capable of moving to a position directly above the developing device 231 disposed lateral to the Z stage 220, in accordance with the movement of the substrate support. The transparent electrode 212 of the transparent substrate 210 is connected to a grounded electrode fixed to the substrate support.

The developing device 231 is similar in configuration to the developing device 8K illustrated in FIG. 2 of the illustrative embodiment and includes a screw 232, a development roller 233, a doctor blade 234, and so forth. The development roller 233 is rotated with a development bias applied thereto by the power source 235.

In accordance with the movement of the substrate support, the transparent substrate 210 is moved at a predetermined speed to a position directly above the developing device 231 and disposed opposite the development roller 233 with a predetermined gap therebetween. Then, the toner on the development roller 233 is transferred onto the transparent electrode 212 of the transparent substrate 210. Accordingly, a toner layer 216 having a predetermined thickness is formed on the transparent electrode 212 of the transparent substrate 210. The toner adhesion amount per unit area relative to the toner layer 216 is adjustable by the toner density in the developing agent, the toner charge amount, the development bias value, the gap between the transparent substrate 210 and the development roller 233, the moving speed of the transparent substrate 210, the rotation speed of the development roller 233, and so forth.

The transparent substrate 210 formed with the toner layer 216 is translated to a position opposite a recording medium 214 adhered to the planar metal plate 215 by a conductive adhesive agent. The metal plate 215 is placed on the substrate 221, which is provided with a load sensor and placed on the Z stage 220. Further, the metal plate 215 is connected to the voltage amplifier 217. The waveform generator 218 provides the voltage amplifier 217 with a transfer voltage including a DC voltage and an alternating voltage. The transfer voltage is amplified by the voltage amplifier 217 and applied to the metal plate 215. If the Z stage 220 is drive-controlled and elevates the metal plate 215, the recording medium 214 starts coming into contact with the toner layer 216. If the metal plate 215 is further elevated, the pressure applied to the toner layer 216 increases.

The elevation of the metal plate 215 is stopped when the output from the load sensor reaches a predetermined value. With the pressure maintained at the predetermined value, a transfer voltage is applied to the metal plate 215, and the behavior of the toner is observed. After the observation, the Z stage 220 is drive-controlled to lower the metal plate 215 and separate the recording medium 214 from the transparent substrate 210. Thereby, the toner layer 216 is transferred onto the recording medium 214.

The behavior of the toner is examined using the microscope 242 and the high-speed camera 243 disposed above the transparent substrate 210. The transparent substrate 210 is formed of the layers of the glass plate 211, the transparent electrode 212, and the transparent insulating layer 213, which are all made of transparent material. It is therefore possible to observe, from above and through the transparent substrate 210, the behavior of the toner located under the transparent substrate 210.

In the present experiment, a microscope using a zoom lens VH-Z75 manufactured by Keyence Corporation was used as the microscope 242. Further, a camera FASTCAM-MAX 120 KC manufactured by Photron Limited was used as the high-speed camera 243 controlled by the personal computer 244. The microscope 242 and the high-speed camera 243 are supported by a camera support. The camera support adjusts the focus of the microscope 242.

The behavior of the toner on the transparent substrate 210 was photographed as follows. That is, the position at which the behavior of the toner was observed was illuminated with light by the light source 241, and the focus of the microscope 242 was adjusted. Then, a transfer voltage was applied to the metal plate 215 to move the toner in the toner layer 216 adhering to the lower surface of the transparent substrate 210 toward the recording medium 214. The behavior of the toner in this process was photographed by the high-speed camera 243.

The structure of the transfer nip in which toner is transferred onto a recording medium is different between the observation experiment equipment illustrated in FIG. 4 and the image forming apparatus of the illustrative embodiment. Therefore, the transfer electric field acting on the toner is different therebetween, even if the applied transfer voltage is the same. To find appropriate observation conditions, transfer voltage conditions allowing the observation experiment equipment to attain favorable density reproducibility on recessed portions of a surface of a recording medium were investigated.

As the recording medium 214, a sheet of FC Japanese paper SAZANAMI manufactured by NBS Ricoh Company, Ltd. was used. As the toner, yellow toner having an average toner particle diameter of approximately 6.8 μm mixed with a relatively small amount of black toner was used. The observation experiment equipment was configured to supply the transfer voltage to a rear surface of the recording medium 214 (i.e. SAZANAMI). Therefore, in the observation experiment equipment, the polarity of the transfer voltage capable of transferring the toner onto the recording medium 214 is opposite the polarity of the transfer voltage employed in the image forming apparatus according to the illustrative embodiment (i.e. positive polarity). A frequency f of the AC component of the secondary transfer voltage was set to approximately 1,000 Hz. Furthermore, the DC component was set to approximately 200 V, and a peak-to-peak voltage Vpp was set to approximately 1,000 V. The toner layer 216 was transferred onto the recording medium 214 with a toner adhesion amount in a range of from approximately 0.4 $mg/cm^2$ to approximately 0.5 $mg/cm^2$. As a result, a sufficient image density was successfully obtained on the recessed portions of the surface of the SAZANAMI paper sheet.

Under the above-described conditions, the behavior of the toner was photographed with the microscope 242 focused on the toner layer 216 on the transparent substrate 210, and the following phenomenon was observed. That is, the toner particles in the toner layer 216 moved back and forth between the transparent substrate 210 and the recording medium 214 due to an alternating electric field generated by the transfer voltage. With an increase in the number of the back-and-forth movements, the amount of toner particles moving back and forth was increased. More specifically, in the transfer nip, there was one back-and-forth movement of toner particles in every cycle 1/f of the AC component of the transfer voltage due to a single action of the alternating electric field.

Figure 5:
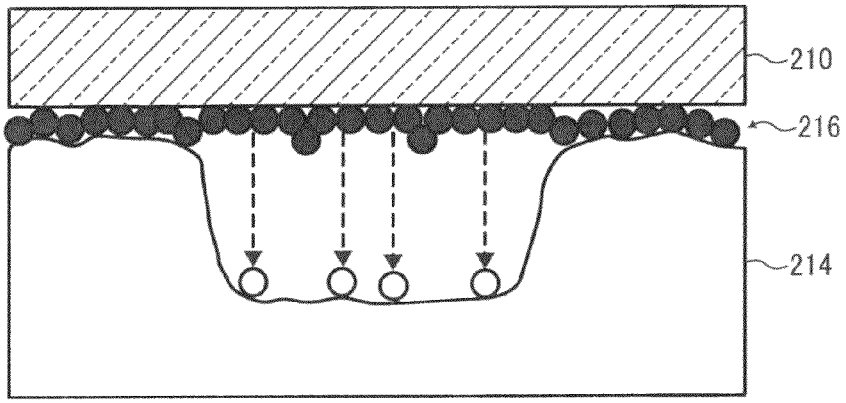
FIG. 5 is an enlarged schematic diagram illustrating behavior of the toner in the secondary transfer nip at the beginning of transfer.
Figure 6:
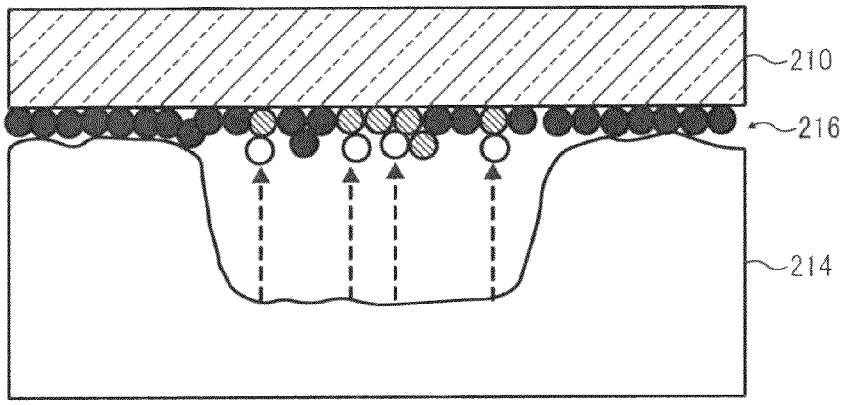
FIG. 6 is an enlarged schematic diagram illustrating behavior of the toner in the secondary transfer nip in the middle phase of transfer.

In the first cycle, only toner particles present on the surface of the toner layer 216 separated from the toner layer 216, as illustrated in FIG. 5. The toner particles then entered the recessed portions of the recording medium 214, and thereafter returned to the toner layer 216, as illustrated in FIG. 6. In this process, the returning toner particles collided with other toner particles remaining in the toner layer 216, thereby reducing the adhesion of the other toner particles to the toner layer 216 or to the transparent substrate 210.

Figure 7:
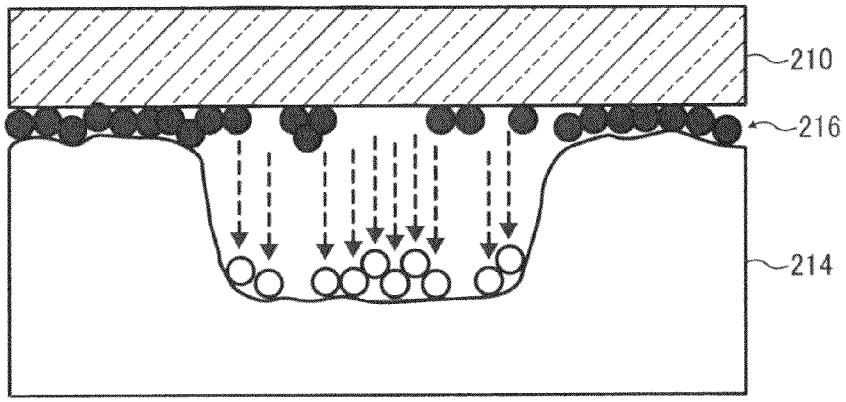
FIG. 7 is an enlarged schematic diagram illustrating behavior of toner in the secondary transfer nip in the last phase of transfer.

In the next cycle, therefore, a larger amount of toner particles than in the last cycle separated from the toner layer 216, as illustrated in FIG. 7. The toner particles then entered the recessed portions of the recording medium 214, and thereafter returned to the toner layer 216, as illustrated in FIG. 6. In this process, the returning toner particles collided with other toner particles remaining in the toner layer 216, thereby reducing the adhesion of the other toner particles to the toner layer 216 or to the transparent substrate 210.

In the next cycle, therefore, a larger amount of toner particles than in the last cycle separated from the toner layer 216, as illustrated in FIG. 7. As described above, the number of toner particles moving back and forth was gradually increased in every back-and-forth movement. After the lapse of a nip passage time, for example, a time corresponding to the actual nip passage time in the observation experiment equipment, a sufficient amount of toner had been transferred to the recessed portions of the recording medium 214.

A description is now provided of different image forming modes according to an illustrative embodiment present invention.

According to the present illustrative embodiment, the image forming apparatus includes different image formation modes, that is, a first mode for a recording medium having a relatively rough surface and a second mode for a normal recording medium. In accordance with an instruction from users, the first mode or the second mode is selected. In the first mode, the secondary transfer bias including the AC component superimposed on the DC component is applied upon image formation. In the second mode, the secondary transfer bias including only the DC component without the AC component is applied upon image formation.

When the recording medium P on which an image is formed has a relatively rough surface, the users may select the first mode through the control panel 50. In this mode, the secondary transfer bias in which the AC component is superimposed on the DC component is used to form an image. With this configuration, generation of the pattern of light and dark in accordance with the surface condition of the recording medium is reduced, if not prevented entirely. A high-quality image can be formed on the recording medium.

By contrast, in a case in which the recording medium P has a surface with relatively low surface roughness, the users may select the second mode through the control panel 50. Accordingly, the secondary transfer bias including only the DC transfer bias without the AC component is employed upon image formation. Generally, for a normal recording medium having relatively low surface roughness, a high-quality image is obtained with the secondary transfer bias including only the DC transfer bias. Moreover, the secondary transfer bias including the AC component adversely affects parts that constitute the secondary transfer nip, for example, the secondary transfer roller 36, the intermediate transfer belt 31, the secondary transfer opposed roller 33, and so forth. In view of the above, it is preferable to apply to the secondary transfer nip the secondary transfer bias without the AC component so as to enhance the product life of these parts.

In general, the greater the secondary transfer bias, the higher the secondary transfer efficiency and the image quality. However, if the secondary transfer bias is too large relative to the electric charge on toner, electric discharge occurs in the secondary transfer nip, causing the toner at a place where the electric discharge occurred to scatter in the secondary transfer nip and thus producing a defective image. For this reason, the secondary transfer bias has a large value within a range in which electric discharge does not occur.

As for the primary transfer bias, the greater the primary transfer bias, the higher the primary transfer efficiency and the image quality. However, if the primary transfer bias is too large, the electric charge on the toner transferred onto the intermediate transfer belt 31 increases. For this reason, the primary transfer bias has a large value within a range in which electric discharge does not occur in the secondary transfer nip supplied with the secondary transfer bias.

In the second mode in which a normal sheet of the recording medium is used, the primary transfer bias and the secondary transfer bias having the above-described configuration are employed to obtain a high-quality image. However, if the same level of the primary transfer bias as in the second mode is used in the first mode for the recording medium having a rough surface, electric discharge occurs in the secondary transfer nip. When compared with the secondary transfer bias including only the DC component as in the second mode, the secondary transfer bias in the first mode includes the AC component superimposed on the DC component, and the maximum absolute value of the secondary transfer bias applied to the secondary transfer nip is substantially large. Consequently, when the toner having the same electric charge as in the first mode using the rough-surface sheet enters the secondary transfer nip, electric discharge occurs at timing at which the absolute value of the secondary transfer bias reaches its maximum value.

According to the present illustrative embodiment, in the first mode in which the secondary transfer bias includes the AC component superimposed on the DC component, the primary transfer bias is lower than that in the second mode in which the secondary transfer bias includes only the DC transfer bias. With this configuration, the electric charge on the toner entering the secondary transfer nip is lower than that in the second mode for the normal recording medium.

The description has been provided of the image formation modes changed by users. Alternatively, the image formation modes may be changed by detecting the surface conditions of the recording medium P. In such a case, the image forming apparatus may include a detector for detecting conditions of the surface of the recording medium P.

Next, a description is provided of image quality adjustment control, also known as process control, performed in predetermined timing by the image forming apparatus according to an illustrative embodiment of the present invention.

According to the present illustrative embodiment, the image quality adjustment control includes, but is not limited to adjustment of image gradation, toner density correction, and color drift correction.

When adjusting gradation of an image, first, 16 pieces of toner patches serving as test toner images are formed on each of the photosensitive drums 2Y, 2M, 2C, and 2K under different image forming conditions (for example, a development potential) such that an amount of toner adhered to the toner patches on the surface of each of the photosensitive drums 2Y, 2M, 2C, and 2K is different from one another. A group of 16 toner patches is hereinafter referred to collectively as a gradation test pattern. The gradation test pattern for each color is transferred onto the intermediate transfer belt 31 in a similar manner as the normal image forming operation. The gradation test pattern for each color transferred onto the intermediate transfer belt 31 is delivered to a position opposite the density detector 38 as the intermediate transfer belt 31 moves so that the amount of toner adhered to each of toner patches is detected by the density detector 38. More specifically, the density detector 38 may employ an optical detector and detect an optical density of each of toner patches. Using the detected optical density and a predetermined calculation algorithm for toner adhesion, the amount of toner adhered to the toner patches is obtained.

Figure 8:
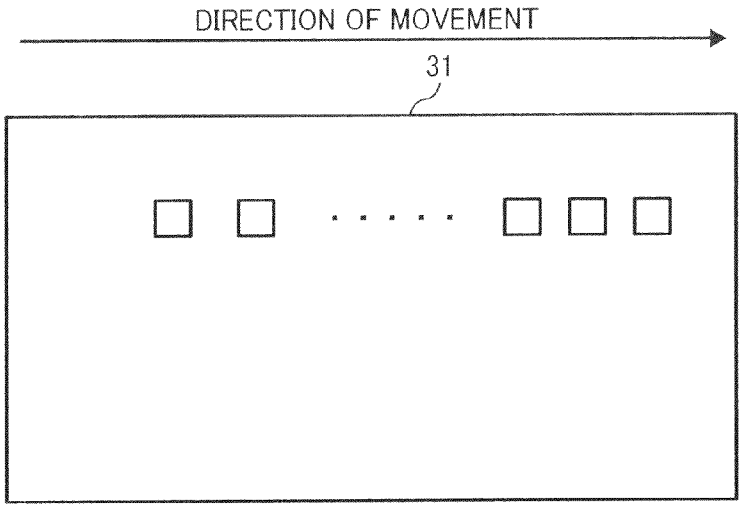
FIG. 8 is a schematic diagram illustrating an example of a gradation test pattern formed on an intermediate transfer belt employed in the image forming apparatus.

With reference to FIG. 8, a description is provided of an example of the gradation test pattern. FIG. 8 is a schematic diagram illustrating the example of the gradation test pattern formed on the intermediate transfer belt 31.

As illustrated in FIG. 8, the gradation test pattern includes 16 pieces of toner patches, each of which has a different amount of toner adhered thereto, arranged on the intermediate transfer belt 31 in the direction of movement thereof. The amount of toner adhered to each of the toner patches is detected by the density detector 38 as each of the toner patches passes by the density detector 38.

After the amount of toner adhered to each of the toner patches is detected, in accordance with a relation of the amount of adhered toner and the image forming conditions (development potential), a product of a linear equation $y=ax+b$ is obtained. Subsequently, a development y, which is an index value indicating a development ability, and a development start voltage Vk are obtained. The development y is a slope "a" when a horizontal axis represents the development potential and a vertical axis represents the amount of adhered toner. The development start voltage Vk is an intercept "b" when the horizontal axis represents the development potential and the vertical axis represents the amount of adhered toner. Based on the development y and the development start voltage Vk thus obtained, the image forming conditions such as the intensity of laser light projected from the optical writing unit 80 against the photosensitive drums 2, the charging bias of the charging devices 6 (6K, 6C, 6M, and 6Y), and the development bias of the developing devices 8 (8K, 8C, 8M, and 8Y) are adjusted to obtain a desired development potential, with which an appropriate amount of toner is adhered.

When correcting a toner density, a test toner image consisting of a solid color patch having a certain area is formed between successive images (non-image formation area) on the intermediate transfer belt 31 in the continuous printing in the similar or the same manner as the normal image forming operation, for example. Subsequently, the amount of toner adhered to the test toner image is detected by the density detector 38. In accordance with the amount of adhered toner detected by the density detector 38, the amount of toner to be supplied to the developing device is adjusted.

Figure 9:
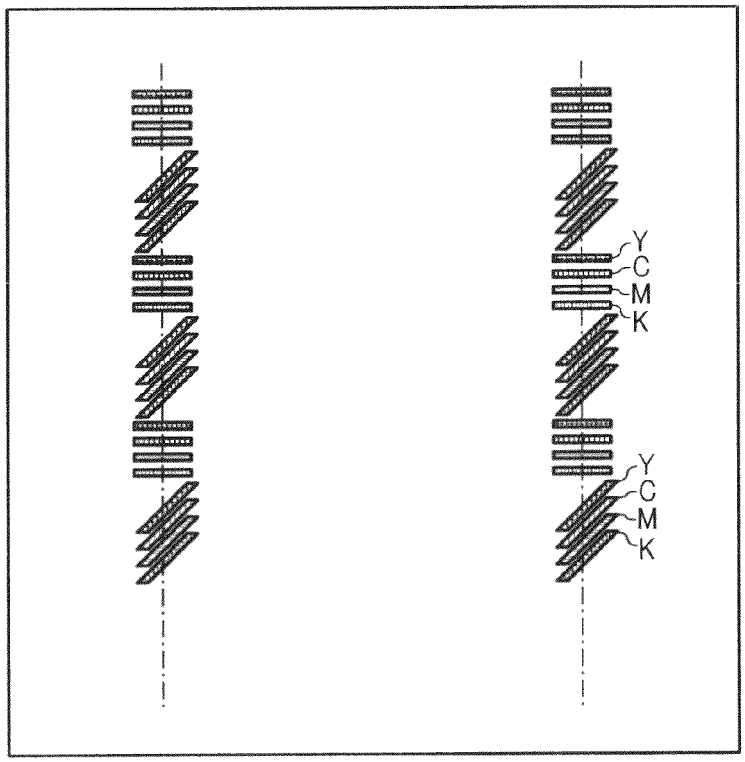
FIG. 9 is a perspective view schematically illustrating an example of a color drift correction pattern formed on the intermediate transfer belt.

With reference to FIG. 9, a description is provided of the color drift correction. FIG. 9 is a schematic diagram illustrating a color-drift correction pattern formed on the intermediate transfer belt 31. The color drift correction is performed after the power is turned on or completion of a print job. As illustrated in FIG. 9, in the color drift correction, the color-drift correction pattern including toner marks (test toner images) is formed for each color on the intermediate transfer belt 31. The toner marks are arranged in a certain manner. The density detector 38 detects the color-drift correction pattern on the intermediate transfer belt 31.

Based on the time at which the density detector 38 detects the toner marks for each color, an amount of drift from an ideal position is calculated, thereby obtaining an amount of required correction. Subsequently, based on the amount of correction, a target rotation speed profile of a drive motor, for example, is corrected, thereby correcting misalignment (color drift) of the relative position of toner images of each color. The amount of correction of misalignment can be fed back to other control associated with adjustment of transfer positions such as writing timing for the optical writing unit.

According to the illustrative embodiment, when performing the image quality adjustment control including the image gradation adjustment, the toner density correction, and the color drift correction, various test toner images described above are formed on the intermediate transfer belt 31 and detected by the density detector 38. According to the present illustrative embodiment, the bias applied to the secondary transfer nip does not adversely affect the image quality adjustment control described above. However, if the image quality adjustment is performed while the bias including the AC component is applied to the secondary transfer nip such as in the first mode for the recording medium with a rough surface, the AC component is supplied to the secondary transfer nip unnecessarily. As the AC component is applied to the secondary transfer nip, there is a greater electric impact on the parts (for example, the secondary transfer roller 36, the secondary transfer opposed roller 33, and the intermediate transfer belt 31) that constitute the secondary transfer nip as described above, thereby shortening the product life cycle of these parts.

Furthermore, in the first mode, the image quality adjustment is performed with the primary transfer bias lower than that in the second mode for the normal sheet. Consequently, if, in the second mode for the normal recording medium, the image quality adjustment is performed with the same condition as in the first mode, the image quality adjustment is not performed properly.

According to the present illustrative embodiment, the image quality adjustment is performed in the second mode. More specifically, during the image quality adjustment, the primary transfer bias (which is greater than that in the first mode) employed in the second mode for the normal recording medium is employed, and the DC bias without the AC component is applied to the secondary transfer area. With this configuration, the image quality is adjusted properly during the second mode for the normal sheet while preventing degradation of parts constituting the secondary transfer nip due to the AC component.

According to the present illustrative embodiment, during adjustment of image quality, the DC bias is applied to the secondary transfer nip. With this configuration, during adjustment of image quality, the second mode is carried out so that a dedicated mode for adjustment of image quality is not required, thereby simplifying overall control of the image forming apparatus. Alternatively, in a case in which the image forming apparatus includes a dedicated mode for adjustment of image quality in which the test toner images are formed on the intermediate transfer belt 31 while application of the bias to the secondary transfer nip is turned off, application of the bias to the secondary transfer nip is turned off during adjustment of image quality.

Upon adjustment of image quality, the amount of toner adhered to the test toner images on the intermediate transfer belt 31 is detected by the density detector 38 as the test toner images pass by the density detector 38. Subsequently, the test toner images pass through the secondary transfer nip and then removed by the belt cleaning device 37 from the intermediate transfer belt 31. When passing through the secondary transfer nip, if the bias causing the toner to move to the secondary transfer roller side is applied to the secondary transfer nip, a large amount of toner in the test toner images sticks to the surface of the secondary transfer roller 36 undesirably. As a result, the rear surface of the successive recording medium is contaminated by the toner. Even when application of the bias to the secondary transfer nip is off, the toner may still move to the secondary transfer roller side due to a mechanical force as the toner passes through the secondary transfer nip. This also causes contamination of the rear surface of the recording medium with toner.

In view of the above, a cleaner may be provided to remove the toner adhered to the surface of the secondary transfer roller 36 to prevent contamination of the rear surface of the recording medium. However, the cleaner generally used for cleaning the secondary transfer roller 36 has a cleaning performance less than the belt cleaning device 37. Thus, if a large amount of toner is adhered to the surface of the secondary transfer roller 36, the cleaner cannot remove the toner adequately, resulting in contamination of the recording medium. In a case in which the toner in the test toner images are transferred onto the secondary transfer roller 36 and the cleaner removes the toner from the secondary transfer roller 36, preferably, a cleaner having a higher cleaning performance than the normal cleaner is employed.

Alternatively, in order to prevent contamination of the rear surface of the recording medium, a moving device for separating the image bearing surface of the intermediate transfer belt 31 and the secondary transfer roller 36 may be provided. In this configuration, the image bearing surface of the intermediate transfer belt 31 and the secondary transfer roller 36 are separated during adjustment of image quality. Although advantageous, this configuration results in an increase in the size of the image forming apparatus and the cost.

In order to prevent contamination of the rear surface of the recording medium, in another approach, the DC bias causing the toner to move to the secondary transfer opposed roller side may be applied to the secondary transfer nip while the test toner images pass through the secondary transfer nip, for example. In this configuration, a bias having a polarity opposite that of the polarity during the image forming operation is simply applied to the secondary nip so that the cleaner with a high cleaning performance is not required to clean the secondary transfer roller 36. Furthermore, the moving mechanism to separate the secondary transfer roller 36 from the intermediate transfer belt 31 is not required, hence reducing the size and the overall cost of the image forming apparatus. A detailed description of application of the bias having a polarity opposite that of the bias applied to the secondary transfer nip upon image formation is described later.

Figure 10A:
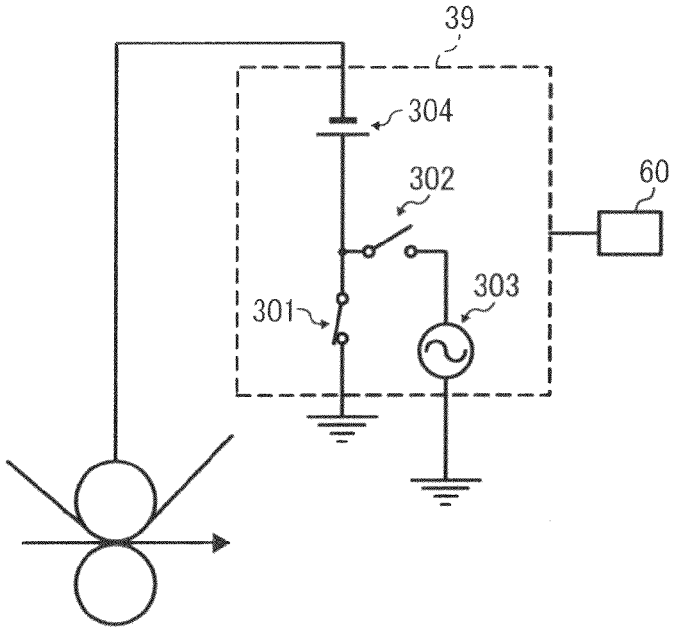
FIGS. 10A through 10D are schematic diagrams illustrating examples of an electric circuit of the secondary transfer power source employed in the image forming apparatus.

With reference to FIGS. 10A through 1 OD, a description is provided of the secondary transfer power source 39. FIGS. 10A through 10D are schematic diagrams illustrating examples of an electric circuit of the secondary transfer power source 39. As illustrated in FIG. 1 OA, the secondary transfer power source 39 includes an AC power source 303, a DC power source 304, a switch 301 and a switch 302. According to the present illustrative embodiment, when applying to the secondary transfer nip only the DC bias such as in the second mode for the normal recording medium, the controller 60 turns on the switch 301 and turns off the switch 302. Accordingly, the bias having the DC component output from the DC power source 304 is applied to the secondary transfer nip.

Figure 10B:
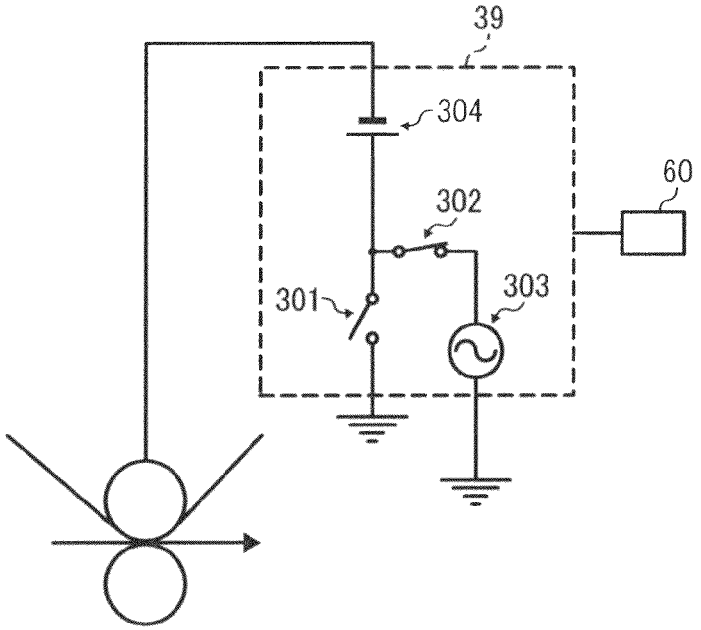

By contrast, as illustrated in FIG. 10B, when applying to the secondary transfer nip the superimposed bias in which the AC component is superimposed on the DC component such as in the first mode for the recording medium having a rough surface, the controller 60 turns on both the switch 301 and the switch 302. Accordingly, the bias having the DC component output from the DC power source 304 and the bias having the AC component output from the AC power source 303 are superimposed, and the thus obtained superimposed bias is applied to the secondary transfer nip.

In a case in which the bias is not applied to the secondary transfer nip, the controller 60 turns off both the switch 301 and the switch 302.

Figure 10C:
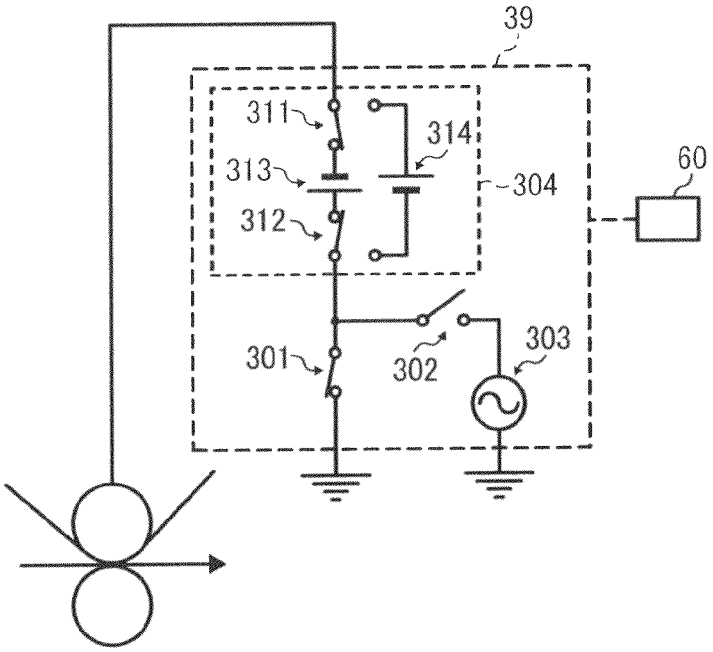
Figure 10D:
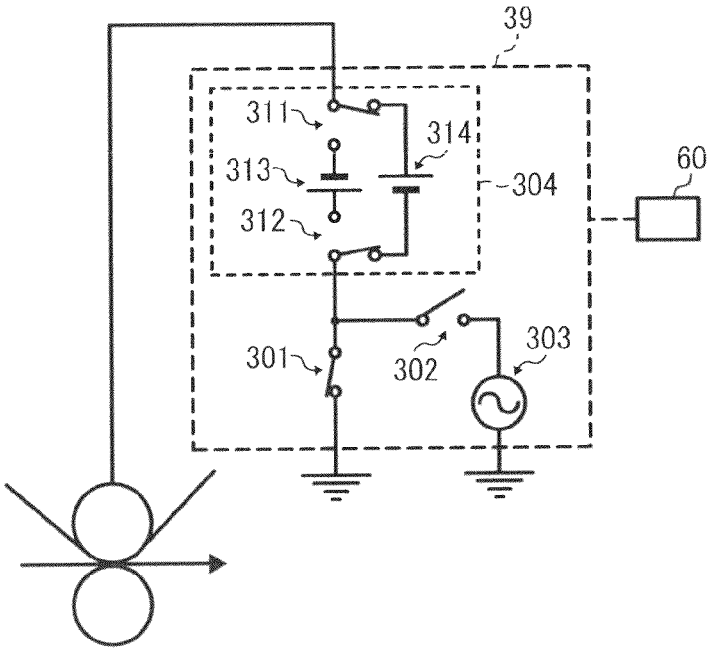

In a case in which a bias having a polarity opposite that of the bias applied to the secondary transfer nip upon image formation, electric circuits illustrated in FIGS. 10C and 10D can be employed. As illustrated in FIGS. 10C and 10D, the secondary transfer power source 39 includes the AC power source 303, the DC power source 304, the switch 301, and the switch 302. The DC power source 304 includes a first switch 311, a second switch 312, a first output section 313, and a second output section 314. The first output section 313 outputs a bias including a DC component for transferring the toner image borne on the surface of the intermediate transfer belt 31 onto the recording medium. The second output section 314 outputs a bias including a DC component having a polarity opposite that of the DC component output from the first output section 313.

In a case in which the DC bias is applied to the secondary transfer nip such as in the second mode for the normal recording medium, as illustrated in FIG. 10C, the controller 60 turns on the switch 301 and turns off the switch 302. Both the first switch 311 and the second switch 312 of the DC power source 304 are connected to the first output section 313. In this configuration, the bias including the DC component output from the first output section 313 of the DC power source 304 is applied to the secondary transfer nip.

In a case in which the superimposed bias including the AC component superimposed on the DC component is applied to the secondary transfer nip such as in the first mode for the recording medium having a rough surface, the switch 301 and the switch 302 in the second mode (shown in FIG. 10C) are changed to the state shown in FIG. 10B.

By contrast, in a case in which the DC bias causing the toner to move to the secondary transfer opposed roller side is applied to the secondary transfer nip while the test toner image passes through the secondary transfer nip, the switch 301 is turned on and the switch 302 is turned off as illustrated in FIG. 10D. Both the first switch 311 and the second switch 312 of the DC power source 304 are connected to the second output section 314. In this configuration, the bias having the DC component output from the second output section 314 of the DC power source 304 is applied to the secondary transfer nip.

The configuration of the secondary transfer power source 39 is not limited to the configurations described above. The secondary transfer power source 39 may employ configurations illustrated in FIGS. 11A through 11F described below.

Figure 11A:
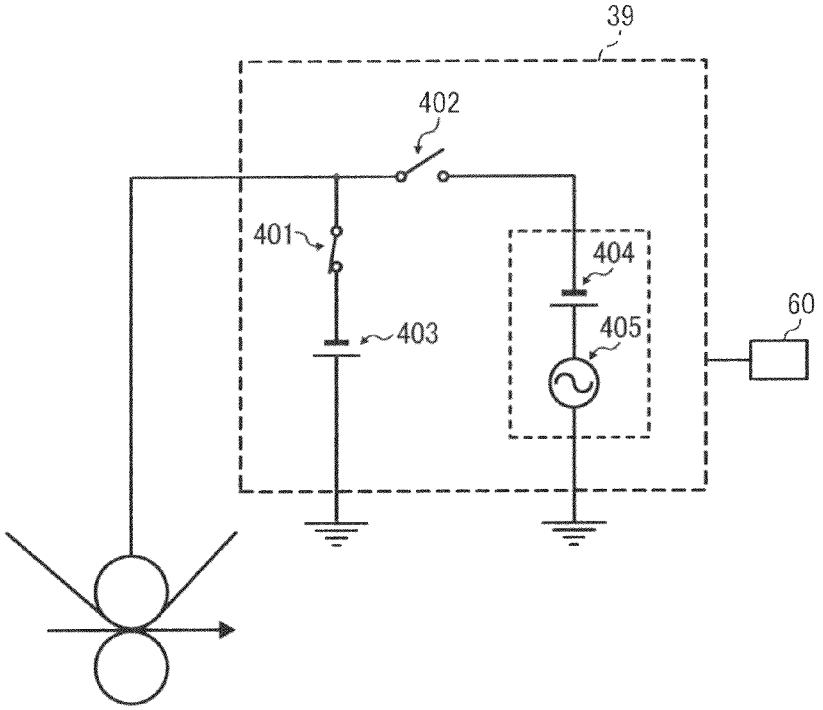
FIGS. 11A through 11F are schematic diagrams illustrating other examples of the electric circuit of the secondary transfer power source.

As illustrated in FIG. 11A, the secondary transfer power source 39 includes a first DC power source 403, a second DC power source 404, and an AC power source 405. In FIG. 11A, when applying the DC bias to the secondary transfer nip such as in the second mode for the normal recording medium, the controller 60 turns on the switch 401 and turns off the switch 402. Accordingly, the bias including the DC component output from the first DC power source 403 is applied to the secondary transfer nip.

Figure 11B:
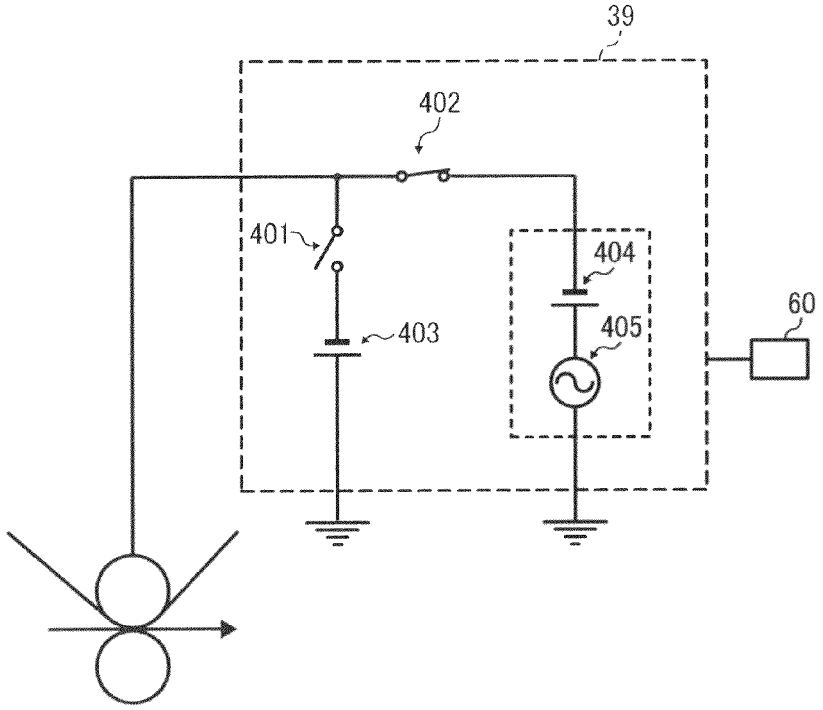

By contrast, in a case in which the superimposed bias including the AC component superimposed on the DC component is applied to the secondary transfer nip such as in the first mode for the recording medium having a rough surface, the controller 60 turns off the switch 401 and turns on the switch 402 as illustrated in FIG. 11B. In this configuration, the bias including the DC component output from the second DC power source 404 and the bias including the AC component output from the AC power source 405 are superimposed, and the thus obtained superimposed bias is applied to the secondary transfer nip.

In a case in which no bias is applied to the secondary transfer nip, the controller 60 turns off the switch 401 and the switch 402.

In a case in which the bias having the polarity opposite that of the bias applied upon image formation is applied to the secondary transfer nip, electric circuits illustrated in FIGS. 11C through 11F can be employed.

Figure 11C:
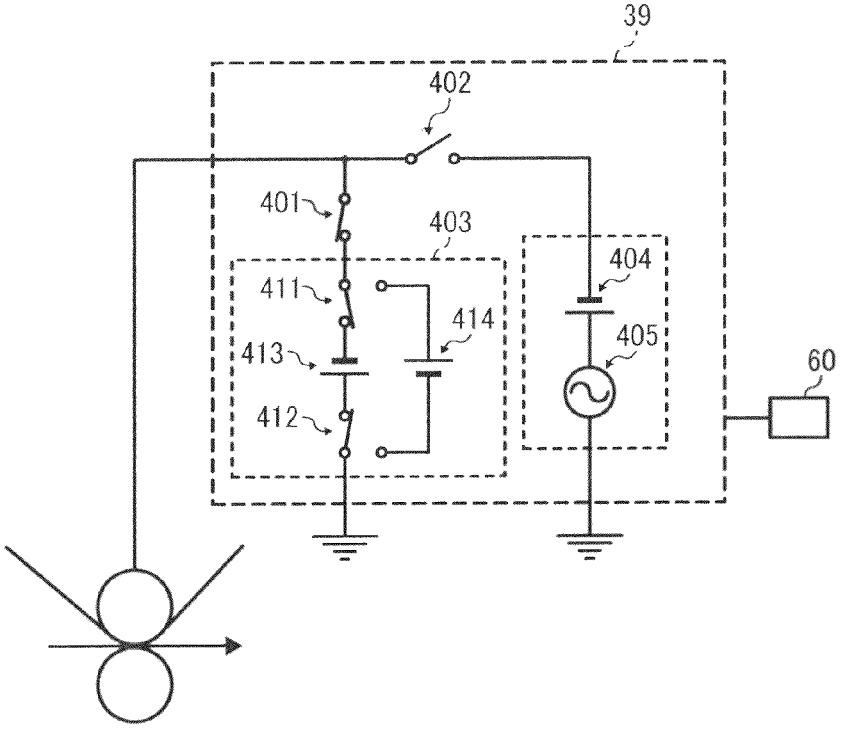
Figure 11D:
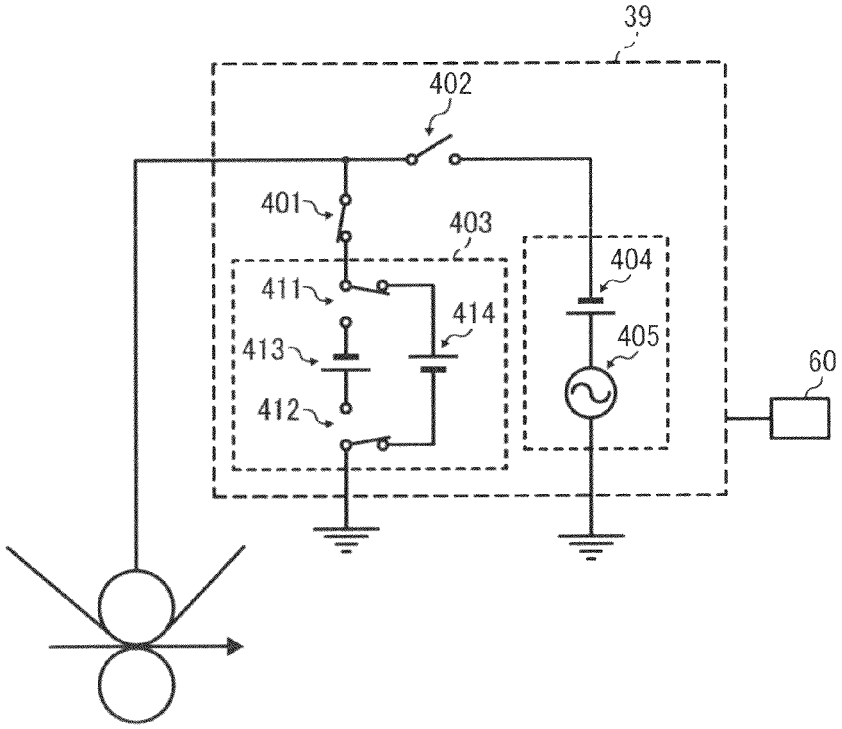

As illustrated in FIGS. 11C and 11D, the secondary transfer power source 39 includes the first DC power source 403, the second DC power source 404, the switch 401, and the switch 402. The first DC power source 403 includes a first switch 411, a second switch 412, a first output section 413, and a second output section 414. The first output section 413 outputs the bias including the DC component for transferring the toner image borne on the surface of the intermediate transfer belt 31 onto the recording medium. The second output section 414 outputs to the secondary transfer nip the bias including the DC component having a polarity opposite that of the DC component output from the first output section 413.

In this configuration, in a case in which the DC bias is applied to the secondary transfer nip such as in the second mode for the normal recording medium, the controller 60 turns on the switch 401 and turns off the switch 402 in the secondary transfer power source 39. A illustrated in FIG. 11C, the first switch 411 and the second switch 412 of the first DC power source 403 are connected to the first output section 413. In this configuration, the bias including the DC component output from the first output section 413 of the first DC power source 403 is applied to the secondary transfer nip.

In a case in which the superimposed bias including the AC component superimposed on the DC component is applied to the secondary transfer nip such as in the first mode for the recording medium having a rough surface, the switch 401 and the switch 402 in the second mode are changed to the state shown in FIG. 11B by the controller 60.

By contrast, in a case in which the DC bias causing the toner to move to the secondary transfer opposed roller side is applied to the secondary transfer nip while the test toner image passes through the secondary transfer nip, the switch 401 is turned on and the switch 402 is turned off as illustrated in FIG. 11D. As illustrated in FIG. 11D, both the first switch 411 and the second switch 412 are connected to the second output section 414. In this configuration, the bias having the DC component output from the second output section 414 of the first DC power source 403 is applied to the secondary transfer nip.

Figure 11E:
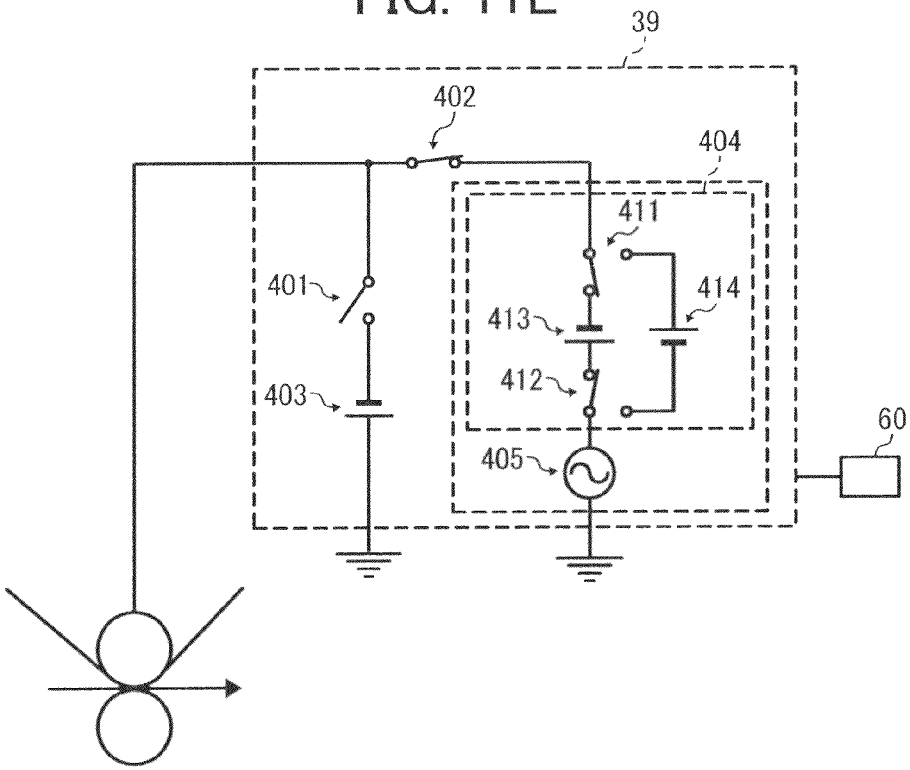
Figure 11F:
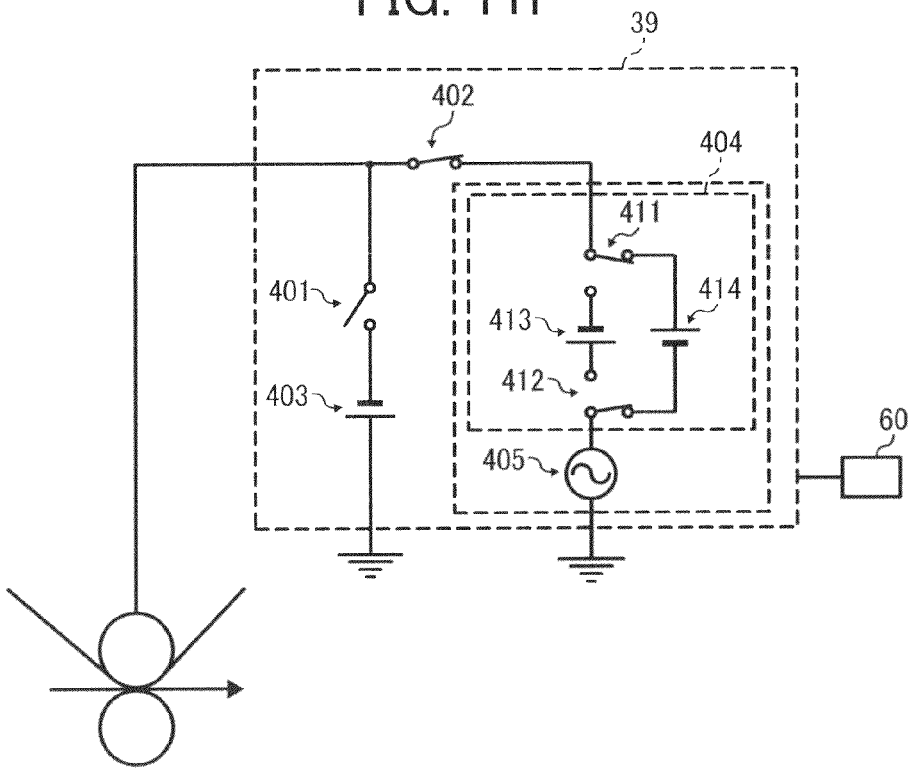

With reference to FIGS. 11E and 11F, a description is provided of another example of the secondary transfer power source 39. As illustrated in FIGS. 11E and 11F, the secondary transfer power source 39 includes the first DC power source 403, the second DC power source 404, the switch 401, and the switch 402. The second DC power source 404 includes the first switch 411, the second switch 412, the first output section 413, and the second output section 414. The first output section 413 outputs the bias including the DC component for transferring the toner image borne on the surface of the intermediate transfer belt 31 onto the recording medium. The second output section 414 outputs to the secondary transfer nip the bias including the DC component having a polarity opposite that of the DC component output from the first output section 413.

In a case in which the superimposed bias including the AC component superimposed on the DC component is applied to the secondary transfer nip such as in the first mode for the recording medium having a rough surface, as illustrated in FIG. 11E, the controller 60 turns off the switch 401 and turns on the switch 402. A illustrated in FIG. 11E, the first switch 411 and the second switch 412 are connected to the first output section 413. In this configuration, the superimposed bias, in which the DC component output from the first output section 413 of the second DC power source 404 and the AC component output from the AC power source 405 are superimposed, is applied to the secondary transfer nip.

By contrast, in a case in which the DC bias causing the toner to move to the secondary transfer opposed roller side is applied to the secondary transfer nip while the test toner image passes through the secondary transfer nip, the switch 401 is turned off and the switch 402 is turned on as illustrated in FIG. 11F. As illustrated in FIG. 11F, both the first switch 411 and the second switch 412 are connected to the second output section 414. In this configuration, the bias having the DC component output from the second output section 414 of the second DC power source 404 is applied to the secondary transfer nip. In this case, preferably, an output value of the AC power source 405 is zero.

In a case in which the DC component is applied to the secondary transfer nip such as in the second mode for the normal recording medium, the switch 401 and the switch 402 in the second mode are changed to the state shown in FIG. 11A by the controller 60.

[Variation]

Figure 12:
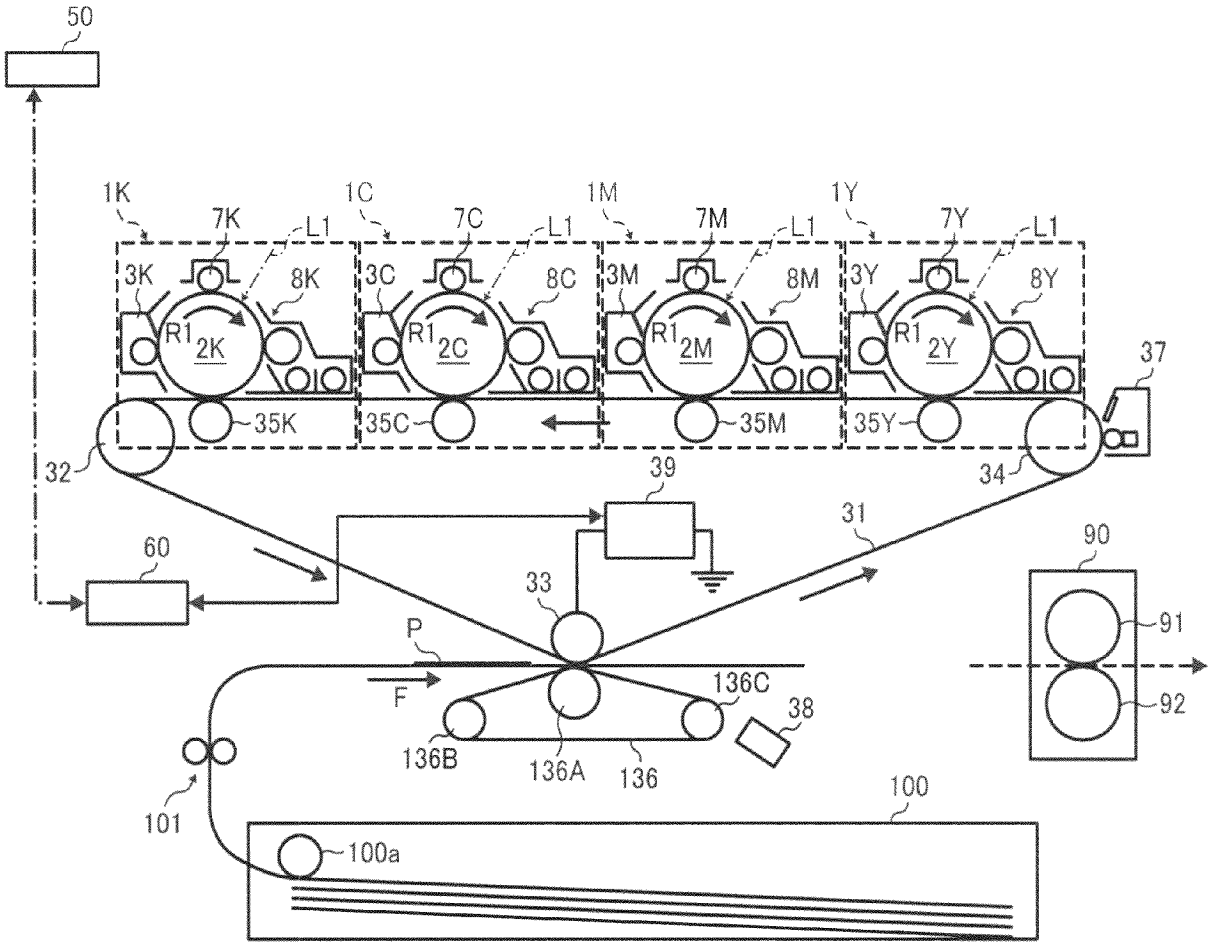
FIG. 12 is a schematic diagram illustrating an image forming apparatus according to another illustrative embodiment of the present invention.

With reference to FIG. 12, a description is provided of a variation of the image forming apparatus.

FIG. 12 is a schematic diagram illustrating a variation of the image forming apparatus. According to the present illustrative embodiment, the image forming apparatus is a printer and includes a secondary transfer belt 136, in place of the secondary transfer roller 36. The secondary transfer belt 136 is entrained about a nip forming roller 136A, and two rollers 136B and 136C, and stretched taught. Reference characters R1 indicates a direction of rotation of the photosensitive drums 2K, 2C, 2M, and 2Y.

According to the present illustrative embodiment, the position of the density detector 38 is different from the foregoing embodiments. More specifically, the density detector 38 of the foregoing embodiment is disposed outside the loop formed by the intermediate transfer belt 31, facing the outer circumferential surface of the intermediate transfer belt 31 so that the amount of toner adhered to the test toner images on the intermediate transfer belt 31 is detected. By contrast, in this variation as illustrated in FIG. 12, the test toner images are transferred from the intermediate transfer belt 31 onto the secondary transfer belt 136, and the density detector 38 is disposed outside the loop formed by the secondary transfer belt 136, facing the outer circumferential surface of the secondary transfer belt 136. The amount of toner adhered to the test toner images on the secondary transfer belt 136 is detected.

In this variation, because the surface of the secondary transfer belt 136 is smooth, when transferring the test toner images from the intermediate transfer belt 31 onto the secondary transfer belt 136, a sufficient transfer efficiency can be achieved using the secondary bias without the AC component. As described above, the secondary transfer bias including the AC component shortens the product life of the parts constituting the secondary transfer nip as described above.

According to the present illustrative embodiment, similar to the foregoing embodiments, adjustment of image quality is performed in the second mode. More specifically, during adjustment of image quality, the primary transfer bias (greater than the first mode) used in the second mode is employed, and the DC bias without the AC component is applied to the secondary transfer area.

It is to be noted that in a configuration in which the amount of toner adhered to the test toner images is detected after the test toner images are secondarily transferred in the secondary transfer nip such as in the variation, the secondary transfer bias for the secondary transfer of the test toner images may include the same DC transfer bias as in the image forming operation. However, because the test toner images are not transferred onto the recording medium P, preferably, the DC transfer bias is lower than that in the image forming operation.

EXPERIMENT 1

Next, with reference to FIG. 13, a description is provided of a first experiment (EXPERIMENT 1) of image density adjustment performed by the present inventors.

In the Experiment 1, a test machine having the same configurations as the image forming apparatus of the illustrative embodiments was used for the following experiments, and a color image was formed on the recording medium continuously. The linear velocity was changed for different sheet thicknesses. For example, for the recording medium having the basis weight of 220 gsm or less, the linear velocity was 352.8 mm/s. For the sheet having the basis weight of greater than 220 gsm, the linear velocity was 246.96 mm/s. An image was formed on 100 sheets continuously per print job, and adjustment of image density was performed every 1000 sheets or 1000 prints. The contents of the image density correction are similar to or the same as the foregoing embodiments.

The DC component of the secondary transfer bias used in the test machine was under constant current control, and the AC component thereof was under constant voltage control. The DC component (direct current) was approximately −60 μA. The peak-to-peak voltage Vpp of the AC component was approximately 7 kV, and the frequency of the AC component was approximately 500 Hz. In the Experiment 1, a bias including only the DC bias having a polarity opposite that of the DC component of the secondary transfer bias was applied to the secondary transfer nip at specific times such as between successive recording media sheets in the secondary transfer nip. More specifically, the DC bias of approximately +5 μA including only the DC component under constant current control was applied to the secondary transfer nip between successive recording media sheets in the secondary transfer nip.

In the Experiment 1, a configuration in which the DC bias was applied to the secondary transfer nip at a time between successive recording media sheets in the secondary transfer nip upon adjustment of image gradation/density was referred to as an Embodiment 1 and compared with a Comparative Example 1 in which a bias including an AC component and a DC component having a polarity opposite that of the DC component of the secondary transfer bias was applied to the secondary transfer nip upon adjustment of image gradation/density.

FIG. 13 shows the results of the Experiment 1. In FIG. 13, GOOD indicates that the image density was adjusted without a mechanical problem. POOR indicates that a mechanical problem occurred or adjustment of image gradation/density did not finish properly.

As shown in FIG. 13, in the Comparative Example 1, when 100000 prints were made, leakage occurred in the secondary transfer bias, and a mechanical problem also occurred. By contrast, in the Embodiment 1, even when 100000 prints were made, adjustment of the image gradation/density was performed properly. Furthermore, when 120000 prints were made, adjustment of image gradation/density was performed properly.

EXPERIMENT 2

With reference to FIG. 14, a description is provided of a second experiment (EXPERIMENT 2).

In the Experiment 2, a test machine having the same configuration as the Experiment 1 was used, and a color image was printed out continuously. In the Experiment 2, a solid color patch was formed at the non-image formation area every 10 prints, and the amount of toner adhered thereto was detected on the secondary transfer belt 136 by the density detector 38. Subsequently, the toner density correction was performed. The contents of the toner density correction is similar to or the same as the foregoing embodiments.

In the Experiment 2, a configuration in which a DC bias of +5 μA under constant current control was applied to the secondary transfer nip between successive recording media sheets in the secondary transfer nip upon adjustment of toner density is referred to as an Embodiment 2. A configuration in which a bias including a DC component greater than that of the Embodiment 2, for example, a DC bias of +10 μA under constant current control was applied to the secondary transfer nip upon adjustment of toner density is referred to as an Embodiment 3. A configuration in which a bias including an AC component and a DC component having a polarity opposite that of the DC component of the secondary transfer bias was applied to the secondary transfer nip upon adjustment of toner density is referred to as a Comparative Example 2.

In the Experiment 2, the toner once transferred onto the secondary transfer roller 36 sticking undesirably to the rear surface of the recording medium was evaluated. Contamination of the rear surface of the recording medium was graded on a five point scale of 1 to 5, where 5 means that no contamination was observed. 4 means that contamination was hardly visible, but there was slight contamination. 3 means that contamination was visible. 2 means contamination was easily seen. 1 means contamination was significant.

As shown in FIG. 14, in the Comparative Example 2, when the total number of prints exceeded 30000, contamination of the recording medium increased. When 90000 prints were made, the evaluation dropped to 2. By contrast, in the Embodiments 2 and 3, contamination of the recording medium was 5 when 80000 prints were made.

The above-described image forming apparatus is an example of the image forming apparatus of the present invention. The present invention includes the following embodiments.

According to an aspect of this disclosure, an image forming apparatus includes an image bearing member (for example, the intermediate transfer belt 31) to rotate and bear a toner image on a surface thereof; a transfer member (for example, the secondary transfer roller 36 and the secondary transfer belt 136) to transfer the toner image from the image bearing member onto a recording medium, the transfer member disposed facing the image bearing member to form a transfer region; a transfer bias application device (for example, the secondary transfer power source 39) to apply to the transfer region a transfer bias including a direct current (DC) component and an alternating current (AC) component to transfer the toner image onto the recording medium as the recording medium passes through the transfer region between the image bearing member and the transfer member; and a controller (for example, the controller 60) to control the transfer bias application device such that a sheet absent period, during which the image bearing member rotates and no recording medium passes through the transfer region, includes a bias change period in which the transfer bias application device selectively applies to the transfer region one of the transfer bias without the AC component and the transfer bias with a peak-to-peak voltage of the AC component less than that applied upon image formation.

With this configuration, degradation of parts such as the transfer member due to the AC component of the transfer bias can be prevented as compared with a configuration in which the AC component is supplied during the sheet absent period.

The sheet absent period refers to a time from which the trailing edge of the recording medium passes through the transfer region to a time at which a leading edge of a successive recording medium enters the transfer region during continuous image forming operation.

According to an aspect of this disclosure, the controller controls the transfer bias application device such that the transfer bias application device selectively applies to the transfer region one of the transfer bias without the AC component and the transfer bias with the peak-to-peak voltage of the AC component less than that applied upon image formation as the image bearing member bearing the toner image passes through the transfer region during the sheet absent period.

With this configuration, the AC component does not cause the toner to scatter when the toner passes through the transfer area during the sheet absent period.

According to an aspect of this disclosure, the image forming apparatus includes a toner density detector (for example, the toner density detector 38) to detect an amount of toner adhered to a test toner image formed on the image bearing member. The controller adjusts image quality based on a detection result provided by the toner density detector, and controls the transfer bias application device such that in the sheet absent period, the transfer bias application device selectively applies to the transfer region one of the transfer bias without the AC component and the transfer bias with a peak-to-peak voltage of the AC component less than that applied upon image formation as the image bearing member bearing the test toner image passes through the transfer region.

With this configuration, the AC component does not cause the toner in the test toner image to scatter when the toner passes through the transfer area during the sheet absent period.

According to an aspect of this disclosure, the image forming apparatus includes a DC transfer bias application device (for example, the DC power source 403) to apply to the transfer region a DC transfer bias without the AC component. The toner density detector detects the amount of toner adhered to the test toner image after the test toner image is transferred onto the transfer member from the image bearing member, and the controller controls the transfer bias application device such that during the bias change period the transfer bias application device stops application of the transfer bias and the DC transfer bias application device applies to the transfer region the DC transfer bias.

With this configuration, the AC component does not affect the test toner image before the toner density detector detects the amount of toner adhered to the test toner image. Accordingly, the density of the toner is detected correctly.

The image forming apparatus further includes a mode changing device to change an image forming mode between a first mode in which the transfer bias application device applies to the transfer region the transfer bias including the DC component and the AC component and a second mode in which the DC transfer bias application device applies to the transfer region the DC bias. During the bias change period, the controller stops the transfer bias application device applying the transfer bias to the transfer region while the DC transfer bias application device applies to the transfer region the DC transfer bias less than that in the second mode.

During the bias change period, the test toner image is transferred onto the transfer member when the recording medium is not present in the transfer area. If the same DC transfer bias as the DC transfer bias when transferring the toner image onto the recording medium from the transfer member is used, electric discharge occurs due to the excessive DC transfer bias, adversely affecting the test toner image. According to the aspect of this disclosure, such electric discharge is suppressed, thereby preventing disturbance of the test toner image.

According to an aspect of the disclosure, the image forming apparatus includes a DC transfer bias application device to apply to the transfer region a DC transfer bias without the AC component and a mode changing device to change an image forming mode between a first mode in which the transfer bias application device applies to the transfer region the transfer bias including the DC component and the AC component and a second mode in which the DC transfer bias application device applies to the transfer region the DC bias. During the bias change period, the controller stops the transfer bias application device to apply the transfer bias while the DC transfer bias application device applies to the transfer region the DC transfer bias.

With this configuration, damage to the transfer member and so forth due to the AC component is prevented with a relatively simple power source.

According to an aspect of the disclosure, the DC bias application device applies to the transfer region a DC bias having a polarity opposite that of the DC component of the transfer bias.

With this configuration, the toner is prevented from moving to the transfer member when passing through the transfer region during the sheet absent period, thereby preventing contamination of the transfer member, and hence preventing contamination of the rear surface of the recording medium.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member to bear a toner image;

a transfer member to form a transfer nip between the image bearing member and the transfer member;

a transfer power source to output a transfer bias to the transfer nip, the transfer power source including a DC power source, an AC power source, a first switch to connect and disconnect the DC power source to the transfer nip, and a second switch to connect and disconnect the AC power source to the transfer nip; and a controller to control the transfer power source to output the transfer bias, wherein the controller controls the first and second switches to switch modes between a first mode and a second mode, wherein in the first mode the controller turns on both the first switch and the second switch so that the transfer power source outputs the transfer bias including an AC component superimposed on a DC component, wherein in the second mode the controller turns on the first switch and turns off the second switch so that the transfer power source outputs the transfer bias including only the DC component, and wherein the controller turns off both the first and second switches so as to turn off application of the transfer bias to the transfer nip when no sheet passes through the transfer nip.

2. The image forming apparatus according to claim 1, wherein the controller turns off application of the transfer bias to the transfer nip within a time period from when a trailing edge of the sheet passes through the transfer nip to when a leading edge of a successive sheet enters the transfer nip.

3. The image forming apparatus according to claim 1, wherein in the first mode the controller controls the transfer power source so that a polarity of the transfer bias is alternately inverted when the toner image is transferred to the sheet at the transfer nip.

4. The image forming apparatus according to claim 1, wherein the second switch is interposed between the DC power source and the AC power source.

5. The image forming apparatus according to claim 1, wherein the first switch is interposed between the DC power source and ground.

6. An image forming apparatus, comprising:

an image bearing member to bear a toner image;

a transfer member to form a transfer nip between the image bearing member and the transfer member;

a toner detector to detect a test toner image formed on the image bearing member;

a transfer power source to output a transfer bias to the transfer nip, the transfer power source including a DC power source, an AC power source, a first switch to connect and disconnect the DC power source to the transfer nip, and a second switch to connect and disconnect the AC power source to the transfer nip; and a controller to control the transfer power source to output the transfer bias, wherein the controller controls the first and second switches to switch modes between a first mode and a second mode, wherein in the first mode the controller turns on both the first switch and the second switch so that the transfer power source outputs the transfer bias including an AC component superimposed on a DC component, wherein in the second mode the controller turns on the first switch and turns off the second switch so that the transfer power source outputs the transfer bias including only the DC component, and wherein the controller turns off both the first and second switches so as to turn off application of the transfer bias to the transfer nip when the test toner image passes through the transfer nip.

7. The image forming apparatus according to claim 6, wherein the toner detector detects the amount of toner of the test toner image formed on the image bearing member, and the controller adjusts image quality based on a detection result provided by the toner detector.

8. The image forming apparatus according to claim 6, wherein the controller turns off application of the transfer bias to the transfer nip within a time period from when a trailing edge of the sheet passes through the transfer nip to when a leading edge of a successive sheet enters the transfer nip.

9. The image forming apparatus according to claim 6, wherein in the first mode the controller controls the transfer power source so that a polarity of the transfer bias is alternately inverted when the toner image is transferred to the sheet at the transfer nip.

10. An image forming apparatus, comprising:

an image bearing member to bear a toner image;

a transfer member to form a transfer nip between the image bearing member and the transfer member;

a transfer power source to output a transfer bias to the transfer nip, the transfer power source including a first DC power source, a second DC power source, an AC power source, a first switch to connect and disconnect the first DC power source to the transfer nip, and a second switch to connect and disconnect both of the second DC power source and the AC power source to the transfer nip; and a controller to control the transfer power source to output the transfer bias, wherein the controller controls the first and second switches to switch modes between a first mode and a second mode, wherein in the first mode the controller turns off the first switch and turns on the second switch so that the transfer power source outputs the transfer bias including an AC component superimposed on a DC component supplied by the second DC power source, wherein in the second mode the controller turns on the first switch and turns off the second switch so that the transfer power source outputs the transfer bias including only a DC component supplied by the first DC power source, and wherein the controller turns off both the first and second switches so as to turn off application of the transfer bias to the transfer nip when no sheet passes through the transfer nip.

11. The image forming apparatus according to claim 10, wherein the controller turns off application of the transfer bias to the transfer nip within a time period from when a trailing edge of the sheet passes through the transfer nip to when a leading edge of a successive sheet enters the transfer nip.

12. The image forming apparatus according to claim 10, wherein in the first mode the controller controls the transfer power source so that a polarity of the transfer bias is alternately inverted when the toner image is transferred to the sheet at the transfer nip.

13. The image forming apparatus according to claim 10, wherein a first branch including the first DC power source is in parallel with a second branch including both the second DC power source and the AC power source.

14. The image forming apparatus according to claim 10, wherein the first DC power source is interposed between the first switch and ground.

15. The image forming apparatus according to claim 10, wherein both the second DC power source and the AC power source are interposed between the second switch and ground.

16. The image forming apparatus according to claim 10, wherein the DC component of the bias that is output in the first mode and the DC component of the bias that is output in the second mode have the same polarity.

17. The image forming apparatus according to claim 6, wherein the second switch is interposed between the DC power source and the AC power source.

18. The image forming apparatus according to claim 6, wherein the first switch is interposed between the DC power source and ground.

19. An image forming apparatus, comprising:

an image bearing member to bear a toner image;

a transfer member to form a transfer nip between the image bearing member and the transfer member;

a toner detector to detect a test toner image formed on the image bearing member;

a transfer power source to output a transfer bias to the transfer nip, the transfer power source including a first DC power source, a second DC power source, an AC power source, a first switch to connect and disconnect the first DC power source to the transfer nip, and a second switch to connect and disconnect both of the second DC power source and the AC power source to the transfer nip; and a controller to control the transfer power source to output the transfer bias, wherein the controller controls the first and second switches to switch modes between a first mode and a second mode, wherein in the first mode the controller turns off the first switch and turns on the second switch so that the transfer power source outputs the transfer bias including an AC component superimposed on a DC component supplied by the second DC power source, wherein in the second mode the controller turns on the first switch and turns off the second switch so that the transfer power source outputs the transfer bias including only a DC component supplied by the first DC power source, and wherein the controller turns off both the first and second switches so as to turn off application of the transfer nip when the test toner image passes through the transfer nip.

20. The image forming apparatus according to claim 19, wherein the toner detector detects the amount of toner of the test toner image formed on the image bearing member, and the controller adjusts image quality based on a detection result provided by the toner detector.

21. The image forming apparatus according to claim 19, wherein the controller turns off application of the transfer bias to the transfer nip within a time period from when a trailing edge of the sheet passes through the transfer nip to when a leading edge of a successive sheet enters the transfer nip.

22. The image forming apparatus according to claim 19, wherein in the first mode the controller controls the transfer power source so that a polarity of the transfer bias is alternately inverted when the toner image is transferred to the sheet at the transfer nip.

23. The image forming apparatus according to claim 19, wherein a first branch including the first DC power source is in parallel with a second branch including both the second DC power source and the AC power source.

24. The image forming apparatus according to claim 19, wherein the first DC power source is interposed between the first switch and ground.

25. The image forming apparatus according to claim 19, wherein both the second DC power source and the AC power source are interposed between the second switch and ground.

26. The image forming apparatus according to claim 19, wherein the DC component of the bias that is output in the first mode and the DC component of the bias that is output in the second mode have the same polarity.

* * * * *